US011680355B2

(12) United States Patent
Choi et al.

(10) Patent No.: US 11,680,355 B2
(45) Date of Patent: Jun. 20, 2023

(54) WASHING MACHINE AND METHOD FOR ASSEMBLING THE SAME

(71) Applicant: LG Electronics Inc., Seoul (KR)

(72) Inventors: Jaehyun Choi, Seoul (KR); Yohwan Kang, Seoul (KR); Sunghoon Kim, Seoul (KR); Hosung Jang, Seoul (KR); Hwanchan Ryu, Seoul (KR); Hyunjae Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 303 days.

(21) Appl. No.: 16/455,261

(22) Filed: Jun. 27, 2019

(65) Prior Publication Data

US 2020/0002870 A1 Jan. 2, 2020

(30) Foreign Application Priority Data

Jun. 27, 2018 (KR) ..... 10-2018-0074385
Jun. 27, 2018 (KR) ..... 10-2018-0074386
(Continued)

(51) Int. Cl.
*D06F 37/20* (2006.01)
*D06F 39/08* (2006.01)
*D06F 37/26* (2006.01)

(52) U.S. Cl.
CPC ..... *D06F 39/083* (2013.01); *D06F 37/20* (2013.01); *D06F 37/265* (2013.01); *D06F 37/266* (2013.01); *D06F 39/085* (2013.01)

(58) Field of Classification Search
CPC ..... D06F 39/083; D06F 39/085; D06F 37/20; D06F 37/265; D06F 37/266
(Continued)

(56) References Cited

U.S. PATENT DOCUMENTS

2005/0273945 A1 12/2005 Zaccone et al.
2011/0083477 A1* 4/2011 Kim ..... D06F 37/266 68/140
(Continued)

FOREIGN PATENT DOCUMENTS

CN 1188167 7/1998
CN 102121186 7/2011
(Continued)

OTHER PUBLICATIONS

JP2012070810A—machine translation (Year: 2012).*
(Continued)

*Primary Examiner* — Tinsae B Ayalew
(74) *Attorney, Agent, or Firm* — Fish & Richardson P.C.

(57) ABSTRACT

Disclosed is a washing machine including: a gasket, wherein the gasket includes a plurality of nozzles provided on an inner circumferential surface of a gasket body to spray water into a drum, and a plurality of port receiving pipes protruding from an outer circumferential surface of the gasket body and respectively communicating with the plurality of nozzles; a distribution pipe supplying water pumped by a pump to the plurality of nozzles; and a first balancer disposed at a front surface of a tub. At least a portion of the first balancer is spaced apart from the outer circumferential surface of the gasket body, and at least a portion of a transport conduit of the distribution pipe is disposed in a space between the first balancer and the gasket body, and accordingly, separation of the distribution pipe from the gasket is prevented.

20 Claims, 27 Drawing Sheets

(30) Foreign Application Priority Data

Jun. 27, 2018 (KR) ..... 10-2018-0074392
Jun. 18, 2019 (KR) ..... 10-2019-0072391

(58) Field of Classification Search
USPC ..... 68/12.19
See application file for complete search history.

(56) References Cited

U.S. PATENT DOCUMENTS

| | | | | |
|---|---|---|---|---|
| 2014/0033449 | A1 | 2/2014 | Im et al. | |
| 2014/0352363 | A1* | 12/2014 | Kim | D06F 39/088 68/140 |
| 2015/0082838 | A1 | 3/2015 | Gweon | |
| 2017/0241060 | A1* | 8/2017 | Seong | D06F 23/06 |

FOREIGN PATENT DOCUMENTS

| | | |
|---|---|---|
| CN | 102418257 | 4/2012 |
| CN | 102597355 | 7/2012 |
| CN | 103562459 | 2/2014 |
| EP | 2343409 | 7/2011 |
| EP | 2634303 | 9/2013 |
| EP | 2719814 | 4/2014 |
| EP | 3483329 | 5/2019 |
| JP | H1176685 | 3/1999 |
| JP | 2010523195 | 7/2010 |
| JP | 2011139815 | 7/2011 |
| JP | 2012070810 | 4/2012 |
| JP | 2014510607 | 5/2014 |
| KR | 20060098840 | 9/2006 |
| WO | WO2016136154 | 9/2016 |

OTHER PUBLICATIONS

EP Search Report in European Application No. EP19183856, dated Dec. 10, 2019, 8 pages.
PCT International Search Report in International Application No. PCT/KR2019/007666, dated Oct. 25, 2019, 5 pages.
Chinese Office Action in Chinese Appln. No. 201910565240.9, dated Feb. 1, 2021, 16 pages (with English translation).
Office Action in Japanese Appln. No. 2020-572395, dated Feb. 15, 2022, 11 pages (with English translation).
Extended European Search Report in European Appln No. 22167642.2, dated Jan. 2, 2023, 8 pages.

* cited by examiner

WASHING MACHINE AND METHOD FOR ASSEMBLING THE SAME

CROSS-REFERENCE TO RELATED APPLICATIONS

This application claims the priority benefit of Korean Application No. 10-2019-0072391, filed on Jun. 18, 2019, Korean Application No. 10-2018-0074392, filed on Jun. 27, 2018, Korean Application No. 10-2018-0074386, filed on Jun. 27, 2018, and Korean Application No. 10-2018-0074385, filed on Jun. 27, 2018. The disclosures of the prior applications are incorporated by reference in their entirety.

BACKGROUND OF THE INVENTION

1. Field of the Invention

The present invention relates to a washing machine and particularly to a washing machine having nozzles that spray water, discharged from a tub and circulated along a circulation pipe, into a drum.

2. Description of the Related Art

In general, a washing machine is an apparatus for removing a contaminant adhered to clothes, bedding, etc. (hereinafter, referred to as 'the laundry') using a chemical disintegration of water and a detergent and a physical operation such as a friction between water and the laundry. The washing machine includes a tub containing water, and a drum rotatably provided in the tub to accommodate laundry.

Korean Patent Application Publication No. 10-2011-0040180 (hereinafter, referred to as a "related art") discloses a washing machine that circulates water, discharged from a tub, using a circulation pump and sprays the circulated water into a drum through a spray nozzle. The washing machine is in a structure in which a distributer is coupled to the circulation pump to distribute wash water and first and second spray paths are connected to the distributer to guide the wash water to first and second spray nozzles, respectively. In addition, the spray nozzles are connected to a gasket by connectors passing through the gasket and are connected to the spray paths.

The related art discloses a washing machine having two spray nozzles, but the washing machine is not capable of uniformly wetting laundry since spray directions are limited. In particular, although various new technologies for controlling rotation of the drum have been developed to provide diversity to movement of laundry loaded in the drum, it is hard to expect remarkable improvement in performance using the conventional structure.

In addition, the conventional technology has a complex structure because the spray nozzles need to be coupled to the gasket by passing the connectors through the gasket, the spray nozzles connected to the circulation pump need to be in number corresponding to the number of spray nozzles, and a plurality of flow paths and the plurality connectors need to be coupled, respectively. In addition, the manufacturing procedure is bothersome due to the assembling process.

A plurality of nozzles may be provided to spray circulating water into drum in multiple directions. In this case, a structure of installing a distribution pipe to guide circulating water to the plurality of nozzles may be considered.

In this structure, the distribution pipe is to supply water pumped by the circulation pump to the nozzles, and the distribution pipe may be separated from the gasket by spraying pressure of outlet ports discharging circulating water to the nozzles or by an external force from vibration of the tub.

In addition, in a washing machine additionally including a dry function, a supply duct for supplying heated air into the tub and the circulating water supply pipe may be interfered with each other.

In addition, the conventional washing machine is assembled in order of assembling a gasket with a tub, fastening a clamp to the gasket to fixing the gasket to the tub, and fastening a balancer to the tub. However, introduction of a circulating water supply pipe requires a new assembling method different from a conventional assembling method.

SUMMARY OF THE INVENTION

A first object of the present invention is to provide a washing machine that prevents separation of a distribution pipe, which guides circulating water to a plurality nozzles, from a gasket due to spray pressure of water streams.

A second object of the present invention is to provide a washing machine that uses a balancer provided at a front surface of a tub to prevent the separation of the distribution pipe from the gasket.

A third object of the present invention is to provide a washing machine that prevents interference of a supply duct provided in the gasket to supply heated air and the balancer.

A fourth object of the present invention is to provide a method for assembling a washing machine in which the gasket, the distribution pipe, and the balancer do not interfere each other and are not separated by use of the washing machine.

Objects of the present invention should not be limited to the aforementioned objects and other unmentioned objects will be clearly understood by those skilled in the art from the following description.

In order to achieve the above objects, a washing machine according to an embodiment of the present invention comprises a gasket having a plurality of nozzles for spraying water into a drum, a distribution pipe for distributing water pumped by a pump to the plurality of nozzles, and a first balancer disposed at a front surface of a tub.

The gasket includes a gasket body forming a passage connecting a laundry entry hole, which is formed in a casing, and an opening, which is formed in the tub.

The laundry entry hole is formed in a front surface of the casing.

The tub is disposed in the casing, and the opening is formed in a front surface of the tub.

The plurality of nozzles is provided on an inner circumferential surface of the gasket body.

At least a portion of the first balancer is spaced apart from an outer circumferential surface of the gasket body.

The distribution pipe includes: an inlet port introducing the water pumped by the pump; a transport conduit guiding the water introduced through the inlet port; and a plurality of outlet ports supplying water to the plurality of nozzles.

The transport conduit is disposed on the outer circumferential surface of the gasket body, and the plurality of outlet ports protrude from the transport conduit toward the gasket body.

At least a portion of the transport conduit is disposed in a space between the outer circumferential surface of the gasket body and the first balancer.

When the gasket body is bilaterally divided into a first area and a second area, the plurality of nozzles may include a first upper nozzle and a first lower nozzle that are vertically disposed in the first area.

The plurality of nozzles may include a second upper nozzle and a second lower nozzle that are vertically disposed in the second area.

The plurality of outlet ports may include a first upper outlet port for supplying water to the first upper nozzle, and a first lower outlet port for supplying water to the first lower nozzle.

The plurality of outlet ports may include a second upper outlet port for supplying water to the second upper nozzle, and a second lower outlet port for supplying water to the second lower nozzle.

The first balancer may include a position limiting part spaced apart from the outer circumferential surface of the gasket body.

The transport conduit may include a first upper port section forming an upper end of the transport conduit. The first upper port section may be disposed in a space between the position limiting part and the outer circumferential surface of the gasket body.

The first upper outlet port may protrude from the first upper port section.

The gasket may include a plurality of port receiving pipes protruding from the outer circumferential surface of the gasket body, and communicating with the plurality of nozzles, respectively.

The plurality of port receiving pipes may include a first upper port receiving pipe and a first lower port receiving pipe vertically disposed in the first area, and communicating with the first upper nozzle and the first lower nozzles, respectively. The plurality of port receiving pipes may include a second upper port receiving pipe and a second lower port receiving pipe vertically disposed in the second area, and communicating with the second upper nozzle and the second lower nozzles, respectively.

The first upper outlet port and the first lower outlet port may be inserted into the first upper port receiving pipe and the first lower port receiving pipe, respectively. The second upper outlet port and the second lower outlet port may be inserted into the second upper port receiving pipe and the second lower port receiving pipe, respectively.

The first upper port section may include a port surface disposed to face a vertical line passing through a center of the gasket body and having the first upper outlet port disposed thereon, and a supporting surface disposed to face a direction away from the vertical line.

The supporting surface may be brought into contact with the position limiting part. The supporting surface may be spaced apart from the position limiting part at an interval shorter than a length by which the first upper outlet port is inserted into the first upper port receiving pipe.

the first upper port receiving pipe and the first upper outlet port may be disposed higher than a horizontal line passing through a center of the gasket body.

The position limiting part may include an inner surface opposing the supporting surface. An inner surface of the position limiting part and the supporting surface may be inclined in a direction to be farther away from the vertical line from an upper side toward a lower side.

The transport conduit may include a first lower port section having the first lower outlet port disposed thereon, and a guide section extending from the first lower port section to the first upper port section.

An upper side of the guide section may be formed in an arc shape along the outer circumferential surface of the body. The first upper port section may be bent from an upper side of the guide section in a direction to be farther away from the outer circumferential surface of the gasket body.

The first balancer may be disposed external to the first area and extends from above the first upper port section to below the first lower port section. An interval between the first lower port section and the first balancer may be greater than an interval between the first upper port section and the first balancer. The first balancer may be in contact with the first upper port section and spaced apart from the first lower port section.

The first upper and lower outlet ports may protrude from the transport conduit toward the gasket body. The second upper and lower outlet ports may protrude from the transport conduit toward the gasket body. The inlet port may be disposed below the first and second lower outlet ports and protrudes from the transport conduit toward a direction opposite to the gasket body.

The first upper and lower outlet ports may protrude in directions parallel to each other. The first upper and lower port receiving pipes may protrude in directions parallel to each other. The first upper and lower outlet ports and the first upper and lower port receiving pipes may protrude in directions parallel to each other.

The second upper and lower outlet ports may protrude in directions parallel to each other. The second upper and lower port receiving pipes may protrude in directions parallel to each other. The second upper and lower outlet ports and the second upper and lower port receiving pipes may protrude in directions parallel to each other.

The washing machine may further include a second balancer disposed at the front surface of the tub and having at least a portion spaced apart from the outer circumferential surface of the gasket body. When the gasket body is bilaterally divided into a first area and a second area, the first balancer may be disposed external to the first area and the second balancer may be disposed external to the second area.

The transport conduit may include: a first transport conduit disposed on an outer circumferential surface of the first area and guiding the water introduced through the first inlet port; and a second conduit part disposed on an outer circumferential surface of the second area, and guiding the water, introduced through the inlet port, to a nozzle disposed in the second area The first conduit part and the second conduit part may be connected to each other in a section having the inlet port disposed thereon. An upper end of the first conduit part and an upper end of the second conduit part may be separated from each other.

The washing machine may further include a supply duct formed in an upper side of the gasket body and supplying air to the tub.

An upper end of the first balancer and an upper end of the second balancer may be spaced apart from each other. The supply duct may be disposed in a space between the upper end of the first balancer and the upper end of the second balancer.

The supply duct may be disposed in a space between an upper end of the first conduit part and an upper end of the second conduit part.

Alternatively, the first balancer may be disposed in the upper side of the gasket body. The position limiting part may form a lower end of the first balancer. The position limiting part may define an assembling space interposed between the position limiting part is spaced apart from the outer circumferential surface of the gasket body. The assembling space may be open by an interval between the position limiting part and the outer circumferential surface of the gasket body. The position limiting part may extends to below the upper outlet port.

The washing machine may further include a second balancer disposed at the front surface of the tub and disposed in a lower side of the gasket body. The distribution pipe may include a first distribution pipe for supplying water pumped by the pump to the first upper and lower nozzles. The distribution pipe may include a second distribution pipe for supplying water pumped by the pump to the second upper and lower nozzles.

The first distribution pipe may include: a first inlet port introducing the water pumped by the pump; a first transport conduit disposed on an outer circumferential surface of the first area and guiding the water introduced through the first inlet port; and the first upper and lower outlet ports.

The second distribution pipe may include: a second inlet port introducing the water pumped by the pump; a second transport conduit disposed on an outer circumferential surface of the first area and guiding the water introduced through the first inlet port; and the second upper and lower outlet ports.

The first and second balancers may be spaced apart from each other in a vertical direction on left and right sides of the gasket body. An upper end of the second balancer may be disposed below the first inlet port and the first lower outlet port.

A method for assembling a washing machine according to an embodiment of the present invention includes: assembling a gasket having a plurality of nozzles with a front surface of a tub; fixing the gasket assembled with the tub by an annular clamp; assembling a distribution pipe with the gasket assembled with the tub, the distribution pipe which supplies water discharged from the tub to the plurality of nozzles; and after the assembling the distribution pipe, fastening a balancer having a predetermined weight with to front surface of the tub.

In the assembling of the distribution pipe, a transport conduit of the distribution pipe is disposed on an outer circumferential surface of the gasket body. In the assembling of the distribution pipe, a plurality of outlet ports, provided in the distribution pipe, is inserted into a plurality of port receiving pipes protruding from an outer circumferential surface of the gasket body and respectively communicating with the plurality of nozzles.

In the fastening of the balancer, the balancer is disposed external to the outer circumferential surface and external to the transport conduit. In the fastening of the balancer, the balancer is fastened to the front surface of the tub in such a way that an interval between the balancer and a part of the transport conduit, having the outlet port disposed thereon, is shorter than a length by which the outlet ports are inserted into the port receiving pipes.

The assembling of the distribution pipe may be performed after fixing the gasket to the tub using the clamp.

Alternatively, the fixing the gasket to the tub using the clamp may be performed after the assembling the distribution pipe to the gasket.

The details of other embodiments are included in the following description and the accompanying drawings.

The washing machine of the present invention may have one or more effects, as below.

First, the transport conduit of the distribution pipe is disposed in a space between the outer circumferential surface of the gasket body and the balancer, and thus, interference between the gasket, the distribution pipe, and the balancer may be avoided and separation of the distribution pipe from the gasket due to spray pressure of water streams may be prevented.

Second, the upper port section of the transport conduit, where the upper outlet port is disposed, is brought into contact with the position limiting part of the balancer or spaced apart from the position limiting part at an interval shorter than a length by which the upper outlet port is inserted into the upper port receiving pipe of the gasket, and therefore, separation of the distribution pipe from the gasket may be prevented even without an additional structure.

Third, the first and second balancers disposed at the front surface of the tub are disposed on the left and right sides with reference to the gasket, and the upper ends of the first and second balancers are spaced apart from each other to thereby prevent interference between the supply duct, formed in the upper side of the gasket, and the balancer. In addition, the upper ends of the first and second conduit parts forming the left and right sides of the transport conduit are separated from each other to thereby prevent the interference between the supply duct and the distribution pipe.

Fourth, after the distribution pipe is assembled, the distribution pipe is fastened to the front surface of the tub so as to be positioned external to the transport conduit, so that the gasket, the distribution pipe, and the balancer do not interfere one another and are not separated by the use of the washing machine.

Effects of the present invention may not be limited to the above and other objects and other objects which are not described may be clearly comprehended to those of skill in the art to which the embodiment pertains through the following description.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Figure 1:
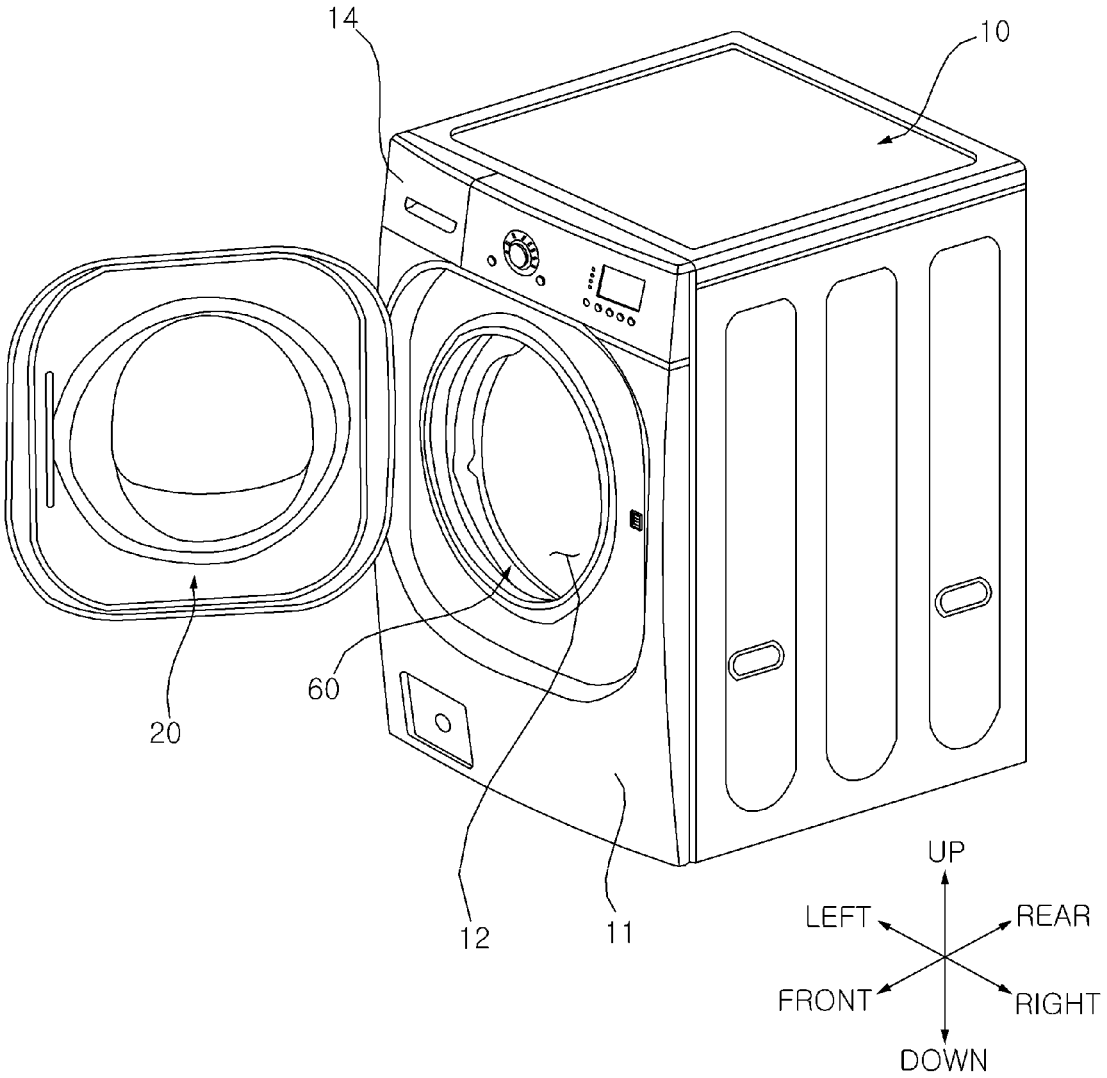
FIG. 1 is a perspective view of a washing machine according to an embodiment of the present invention.

Advantages and features of the present disclosure and methods to achieve them will become apparent from the descriptions of exemplary embodiments herein below with reference to the accompanying drawings. However, the present disclosure is not limited to exemplary embodiments disclosed herein but may be implemented in various different ways. The exemplary embodiments are provided for making the disclosure of the present disclosure thorough and for fully conveying the scope of the present disclosure to those skilled in the art. It is to be noted that the scope of the present disclosure is defined only by the claims. Like reference numerals denote like elements throughout the descriptions.

Hereinafter, the present invention will be described in detail with reference to the accompanying drawings.

Figure 2:
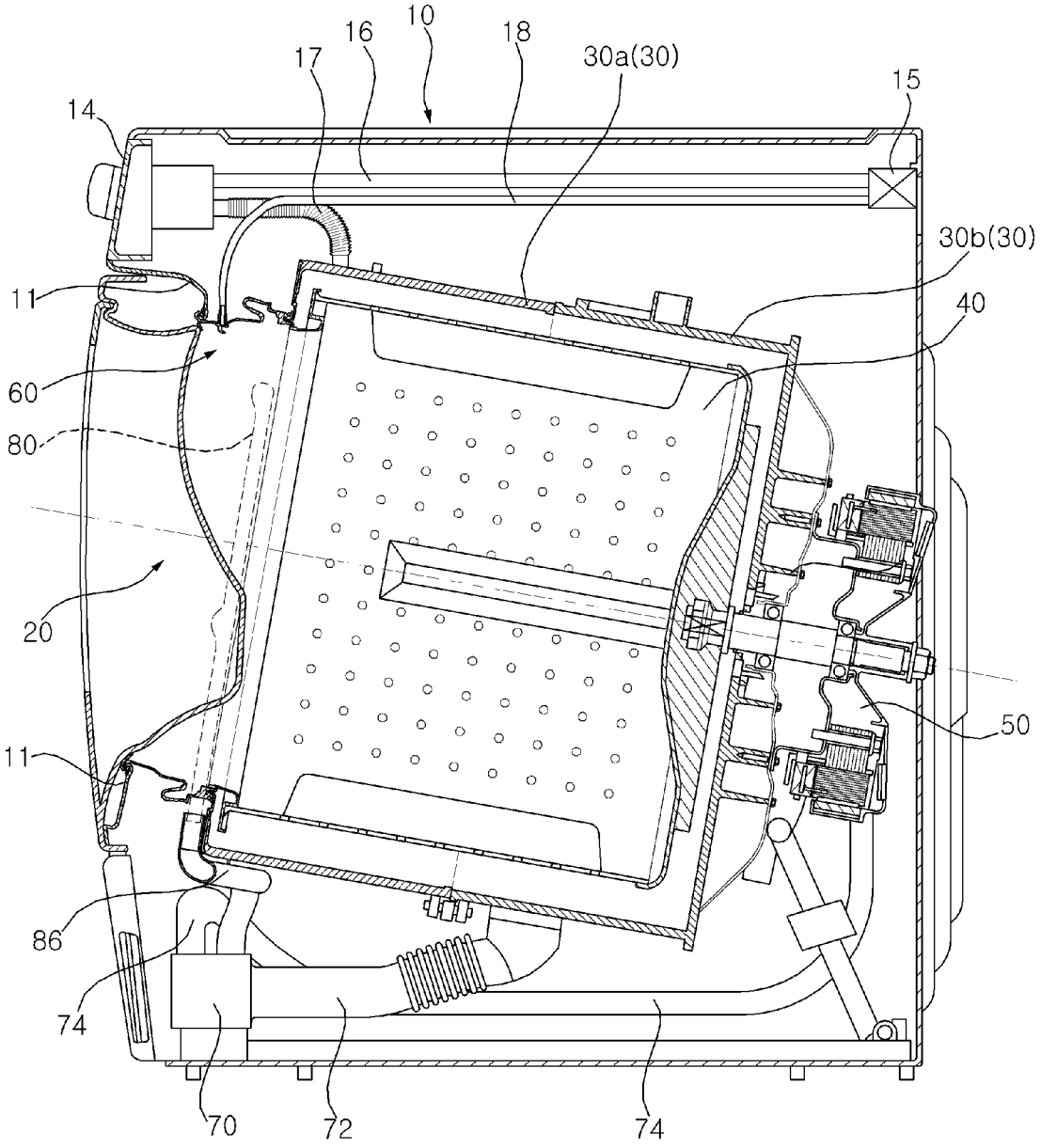
FIG. 2 is a cross-sectional view of the washing machine shown in FIG. 1.

Referring to FIGS. 1 and 2, a washing machine according to the present invention includes a casing 10 forming an exterior appearance of the washing machine, a tub 30 for containing wash water, and a drum 40 rotatably provided in the tub 30 and accommodating laundry. In addition, the washing machine may include a motor (hereinafter, referred to as a "driving unit") for rotating the drum 40.

A front panel 11 having a laundry entry hole 12 formed therein is disposed on a front surface of the casing 10. A door 20 for opening and closing the laundry entry hole 12 is disposed on the front panel 11, and a dispenser 14 for supplying detergent may be installed on the front panel 11.

In addition, a water supply valve 15, a water supply pipe 16, and a water supply hose 17 are installed in the casing 10 so that wash water supplied after passing through the water supply valve 15 and the water supply pipe 16 is mixed with detergent in the dispenser 14 and is then supplied to the tub 30 through the water supply hose 17.

Meanwhile, a direct water supply pipe 18 may be connected to the water supply valve 15 so that wash water is supplied directly to the tub 30 through the direct water supply pipe 18 without being mixed with detergent.

In addition, a pump 70 and a distribution pipe 80 may be installed. The pump 70 and the tub 30 may be connected via a discharge hose 72, and the distribution pipe 80 and the pump 70 may be connected directly to each other or connected via a circulation pipe 86. Accordingly, if the pump 70 operates, wash water contained in the tub 30 may be sprayed into the drum 40 through the distribution pipe 80 and circulate. The pump 70 may be connected to a drain pump 74 and discharge wash water to the outside through the drain pipe 74.

As described above, the pump 70 of the washing machine according to an embodiment of the present invention functions a drain pump for discharging wash water to the outside and as a circulation pump for circulating wash water. On the contrary, a drain pump and a circulation pump may be installed individually, and, in this case, it is obvious that the drain pump is connected to the drain pipe 74 and the circulation pump is connected to the circulation pipe 86.

Meanwhile, the tub 30 may be formed as a single tub body or may be formed as a combination of a first tub body **30*a* and a second tub body 30*b* coupled thereto. In the embodiment of the present invention, an example in which the first tub body 30*a* and the second tub body 30*b* are coupled to form the tub 30 is described. Hereinafter, the first tub body 30*a* is referred to as a "tub" 30**.

The tub 30 is disposed in the casing 10, and an opening 32 (see FIG. 4) is formed at the front of the tub 30 to correspond to the laundry entry hole 12 formed in the front panel 11.

The drum 40 for accommodating laundry may be rotatably provided in the tub 30. The drum 40 receives laundry, and is disposed such that an entrance hole through which laundry is loaded is disposed at a front surface. The drum 40 is rotated about an approximately horizontal rotation center line. In this case, "horizontal" does not refer to the mathematical definition thereof. That is, even in the case where the rotation center line is inclined at a predetermined angle relative to a horizontal state, the axis is more like in the horizontal state than in a vertical state, and thus, it is considered that the rotation center line is substantially horizontal. A plurality of through holes may be formed in the drum 40 so as to introduce water contained in the tub 30 into the drum 40.

A plurality of lifter may be provided on an inner surface of the drum 40. The plurality of liters may be disposed at a predetermined angle relative to the center of the drum 40. When the drum 40 is rotated, laundry repeatedly goes through an operation of being lifted by the lifter and falling.

A driving unit 50 for rotating the drum 40 may be further provided. A driving shaft to be rotated by the driving unit 50 may penetrate the rear of the tub 30 to be coupled to the drum 40.

Preferably, the driving unit 50 includes a direct drive wash motor, and the wash motor may include a stator fixed to the rear of the tub 30, and a rotor rotating by a magnetic force acting in relation with the stator. The driving shaft **38*a*** may rotate integrally with the rotor.

Figure 3:
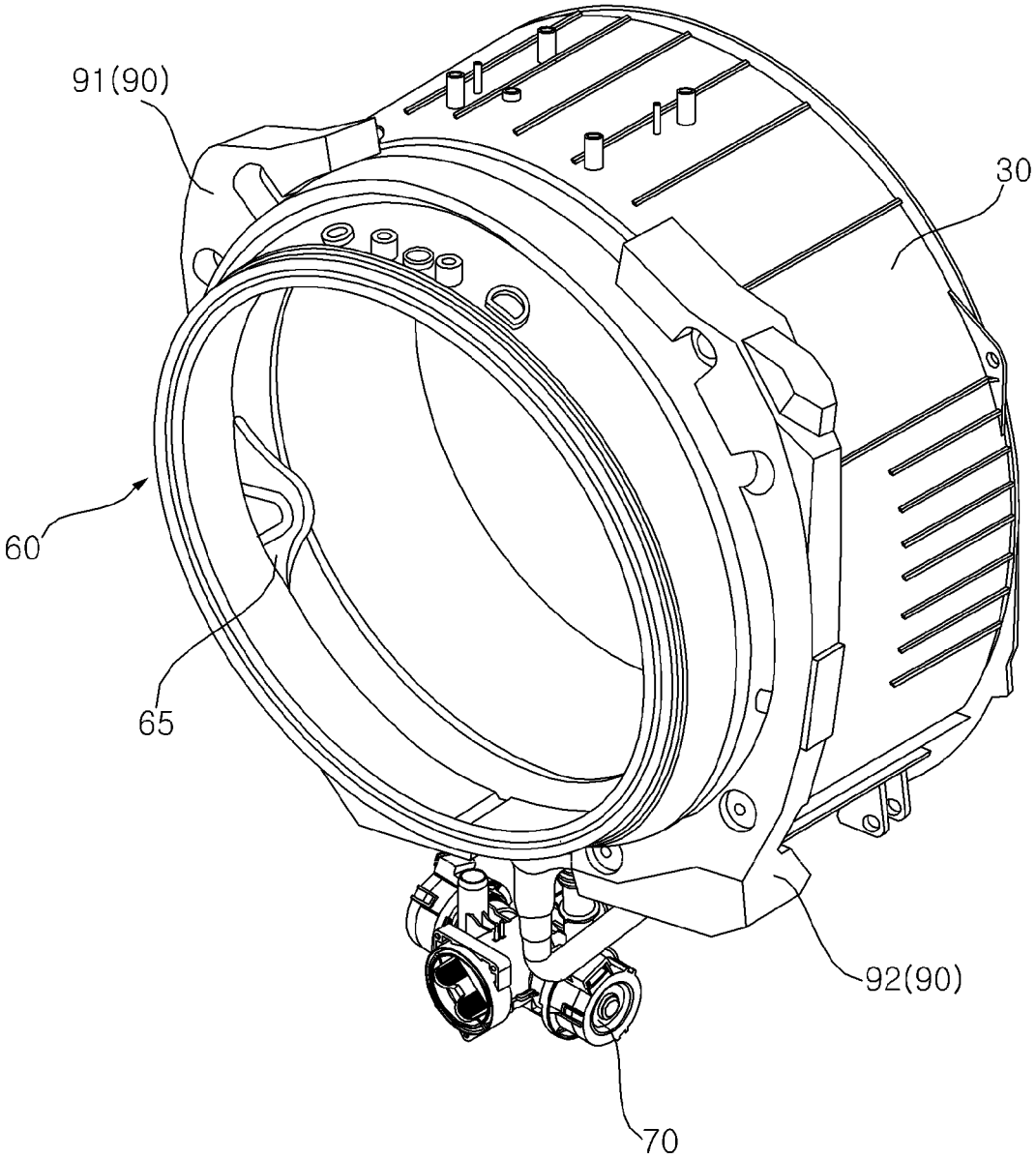
FIG. 3 illustrates a portion of a washing machine according to a first embodiment of the present invention.
Figure 4:
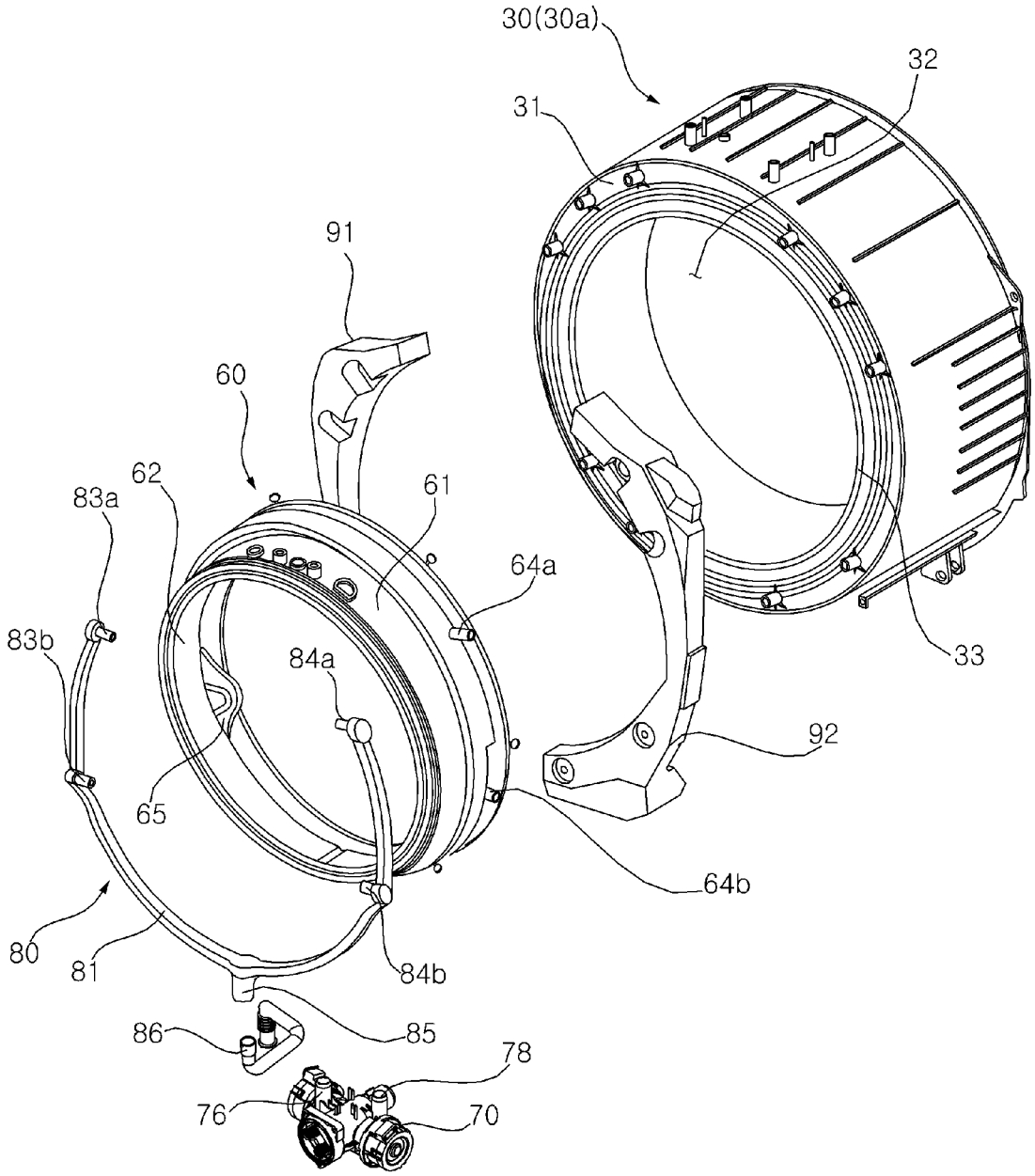
FIG. 4 is an exploded perspective view of an assembly shown in FIG. 3.

Referring to FIGS. 3 and 4, the washing machine according to an embodiment of the present invention includes a gasket 60 for connecting the casing 10 and the tub 30, a plurality nozzle 66 and 67 (see FIG. 6) for spraying water into the drum 40, the pump 70 for pumping water discharged from the tub 30, and a distribution pipe 80 for guiding the water pumped by the pump 70 to the nozzle 66 and 67. In addition, the washing machine may include a balancer 90 disposed at a front surface 31 of the tub 30, and the circulation pipe 86 for guiding the water pumped by the pump 70 to the distribution pipe 80.

Referring to FIGS. 5 to 9 and 15, the gasket 60 includes a gasket body 61 and 62 that forms a passage 60P connecting the laundry entry hole 12 of the casing 10 and the opening 32 of the tub 30. An inner circumferential surface facing the central direction of the gasket body 61 and 62 of the gasket 60 may be referred to as an inner circumferential surface 62, and an outer circumferential surface opposite thereto may be referred to the inner circumferential surface 61.

The inner circumferential surface 62 of the gasket body may form the passage 60P connecting the laundry entry hole 12 and the opening 32. The outer circumferential surface 61 of the gasket body may oppose the inner circumferential surface of the balancer 90. The outer circumferential surface of the gasket body of the gasket 60 may oppose the distribution pipe 80.

The gasket 60 is formed of a flexible substance such as rubber and has an approximate cylindrical shape (hereinafter, referred to as an annular shape). For example, the gasket 60 may be formed of a substance such as Ethylene Propylene Diene Monomer (EPDM), Thermo Plastic Elastomer (TPE), or the like, but aspects of the present invention are not limited thereto.

The gasket is disposed between an entry hole boundary of the front panel 11, which defines the laundry entry hole 12, and a boundary of the tub 30, which defines the opening 32, so that wash water contained in the tub 30 is prevented from leaking from the tub 30.

More specifically, as the front boundary of the gasket 60 is connected to the edge of the entry hole 12 of the front panel 11, and the rear boundary of the gasket 60 is connected to the edge of the opening 32 of the tub 30, the gasket body 61 and 62 connecting the front and rear boundaries of the gasket 60 forms the laundry entry passage 60P. If a space between the tub and the front panel are sealed and the door 20 is closed, the door 20 and the front end of the gasket 60 are tightly brought into contact with each other and the space between the door 20 and the gasket 60 is sealed, and therefore, leakage of wash water is prevented.

A front end part and a rear end part of the gasket 60 are annular, and the gasket 60 has a tubular shape extending from the front end part to the rear end part. The front end part of the gasket 60 is fixed to the casing 10, and the rear end part is fixed to an entrance hole circumference 33 of the tub 30. The gasket 60 may be formed of a flexible or elastic substance. The gasket 60 may be formed of natural rubber or synthetic resin.

The gasket 60 may include a casing coupling part 68*a* coupled to a circumference of the entry hole 12 of the casing 10, a tub coupling part 68*b* coupled to a circumference of the entrance hole circumference 33 of the tub 30, and a gasket body 61 and 62 extending between the casing coupling part 68*a* and the tub coupling part 68*b*.

The casing coupling part 68*a* and the tub coupling part 68*b* have an annular shape. The gasket body 61 and 62 may include an annular front end part connected to the casing coupling part 68*a* and an annular rear end part connected to the tub coupling part 68*b*, and have a tubular shape extending from the front end part to the rear end part.

The circumference of the entry hole 12 of the front panel 11 is rolled outwardly, and the casing coupling part 68 may be fitted into a concave area formed by the outward rolled portion.

An annular groove to be wound by a wire may be formed in the casing coupling part 61. After the wire winds around the groove 61*r*, both ends of the wire are bound, and therefore, the casing coupling part 61 is tightly fixed to the circumference of the entrance hole 12*h*.

The entrance hole circumference 33 of the tub 30, which defines the opening 32 of the tub 30, protrudes from the front surface 31 and is rolled outward, and the tub coupling part 68*b* is fitted in a concave area formed by the outward rolled portion. An annular groove to be wound by a clamp 100 (see FIGS. 16 and 17) may be formed in the tub coupling part 68*b*. The clamp winds around the groove, and both ends of a wire are bounded, and accordingly, the tub coupling part 68*b* may be tightly coupled to the entrance hole circumference 33 of the tub 30.

While the casing coupling part 68*a* is fixed to the front panel 11, the tub coupling part 68*b* is displaceable in accordance with movement of the tub 30. Accordingly, the gasket body 61 and 62 needs to be able to deform in accordance with the displacement of the tub coupling part 68*a*. In order to allow the gasket body to transform easily, the gasket 60 may include a folding part 61*b* between the casing coupling part 68*a* and the tub coupling part 68*b* (or the gasket body 61 and 62), and the folding part 61*b* (hereinafter, referred to as an "inner circumferential part") is folded as the tub 30 moves in a direction of eccentricity (or a radial direction).

The gasket body 61 and 62 may include: a rim 61*a* extending from the casing 10 (or the casing coupling part 68*a*) toward the tub 30 (or the tub coupling part 68*b*) (or toward the rear); an inner circumferential part 61*b* bent outward from the rim part 61*a* and extending toward the casing 10, and bent outward again; and an outer circumferential part 61*c* bent outward from the inner circumferential part 61*b* extending in a direction toward the tub 30, and having a diameter greater than that of the rim part 61*a* and a diameter of the inner circumferential part 61*b*.

The gasket 60 may include an outer door contact portion 683, which is bent outward from the front end of the gasket body 61 and 62 to be brought into contact with a rear surface of the door 20 in the outside of the entry hole 12 in a state in which the door 20 is closed. In the casing coupling part 68*a*, the above-described groove may be formed at a portion extending from an outer side of the outer door contact portion 683.

The gasket 60 may include an inner door contact portion 681, which is bent inward from a front end of the gasket body 61 and 62 to be brought into contact with a rear surface (preferably, the window 22) of the door 20 in a state in which the door 20 is closed.

Meanwhile, during rotation, the drum 40 vibrates (that is, a rotation central line of the drum 40 (see FIG. 2) moves, and accordingly, a central line of the tub 30 (approximately identical to the rotation central line of the drum 40) moves as well. In this case, the moving direction (hereinafter, referred to as an "eccentric direction") has a radial directional component.

The front side of each of the inner circumferential part 61*b* and the outer circumferential part 61*c* may be folded or unfolded when the tub 30 moves in the eccentric direction. When a portion of the inner circumferential part 61*b* is folded as the center of the tub 30 moves in the eccentric direction, a distance between the inner circumferential part 61*b* and the outer circumferential part 61*c* is reduced at the portion, while a distance between the inner circumferential part 61*b* and the outer circumferential part 61*c* is increased at the other portion at which the inner circumferential part 61*b* is unfolded.

Figure 8:
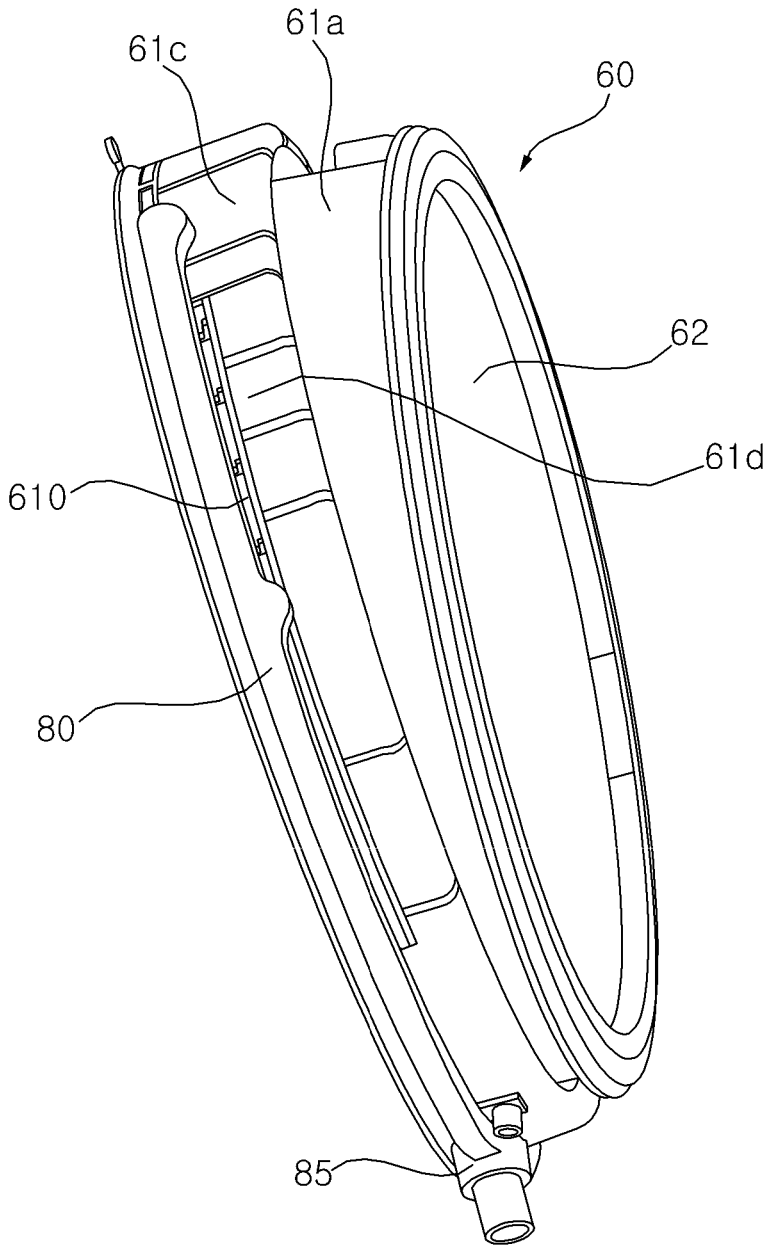
FIG. 8 is a perspective view of the assembly shown in FIG. 6.
Figure 9:
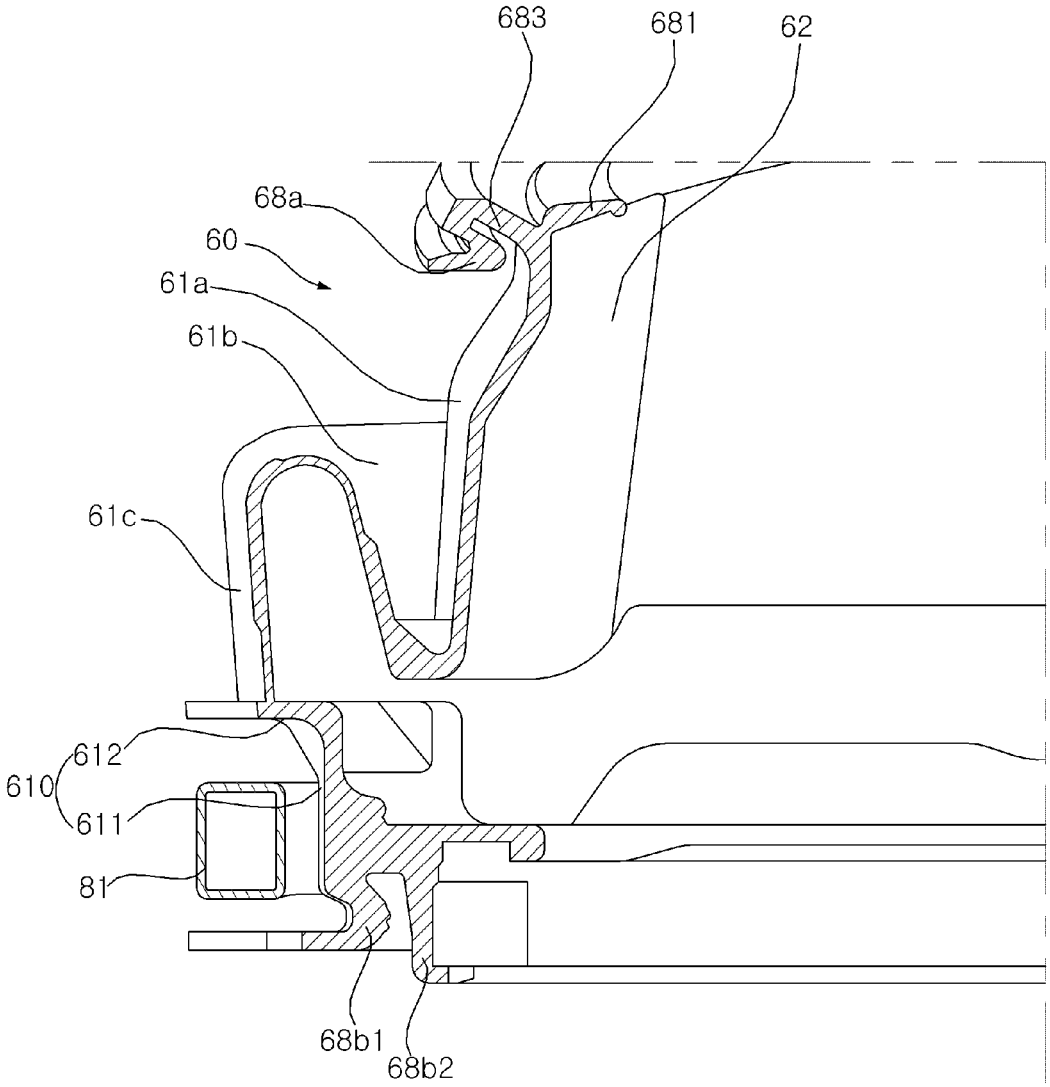
FIG. 9 is a cross-sectional view taken along line I-I'in FIG. 7.

Referring to FIGS. 8 and 9, the gasket 60 includes an accommodation part 610 in which at least a portion of a transport conduit 81 and 82, which will be described later, is disposed. The gasket body 61 and 62 is divided into a front body disposed on the side of the casing 10, and a rear body disposed on the side of the tub 30. The accommodation part 610 may be formed at rear of the gasket body.

The accommodation part 610 may include a boundary surface 612 extending inwardly from a rear end of the front body of the gasket body 61 ad 62. The boundary surface 612 may be bent from the rear end of the front body of the gasket body and extend inward. The boundary surface 612 may be disposed at a boundary that divides the gasket body 61 and 62 into the front body and the rear body.

The accommodation part 610 includes an opposing surface 611 extending rearward from the boundary surface 612. The opposing surface 611 is bent from an inner end of the boundary surface 611 and opposes an inner surface of the transport conduit 81 and 82.

The opposing surface 611 extends from the rear of the gasket body 61 and 62 in a circumferential direction of the gasket body 61 and 62. The boundary surface 612 extends toward the outer side of a radial direction from the opposing surface 611. The boundary surface 612 is connected to the front body of the gasket body 61 and 62.

The accommodation part 610 may be formed to be inward further than a portion adjacent to the front of the accommodation part 610. The accommodation part 610 may be formed in a manner in which a portion of the outer circumferential surface 61 of the gasket 60 is recessed inward or in which a portion of the outer circumferential surface 61 of the gasket 60 protrudes (or raised) to form the accommodation part 610 formed on one side of the protruding portion.

As described above, during rotation of the drum 40, the tub 30 vibrates. Due to the vibration of the tub 30, the gasket 60 formed of a flexible substance may be folded or unfolded and accordingly vibration occurs. Since the casing 10 and the tub 30 are considered relatively rigid compared to the gasket 60, the gasket 60 is not deformed on the side of the casing 10 or on the side of the tub 30. Since the accommodation part 610 is formed to allow the transport conduit 81 and 82 to be seated therein, the accommodation part 610 may be formed to be adjacent to the casing 10 or the tub 30 on the outer circumferential surface 61 of the gasket. Further, since the transport conduit 81 and 82 is configured to guide water pumped by the pump 70 to the nozzles 66 and 67 guiding the water into the drum 40, the transport conduit 81 and 82 may be disposed to be adjacent to the tub 30 in the embodiment of the present invention. Thus, the accommodation part 610 may be formed in the outer circumferential part 61*c*.

Figure 6:
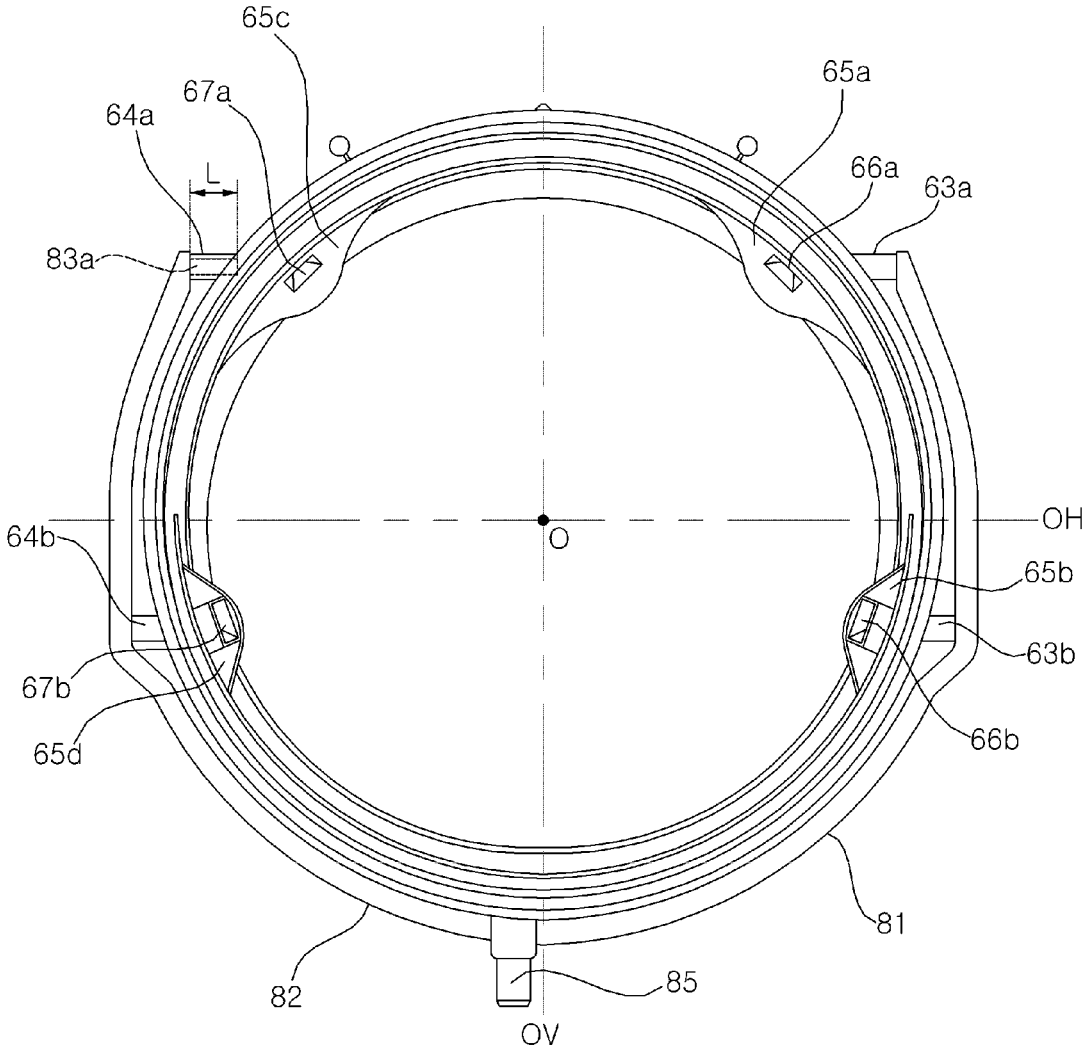
FIG. 6 is a rear view of an assembly including the gasket and a distribution pipe shown in FIG. 4.
Figure 7:
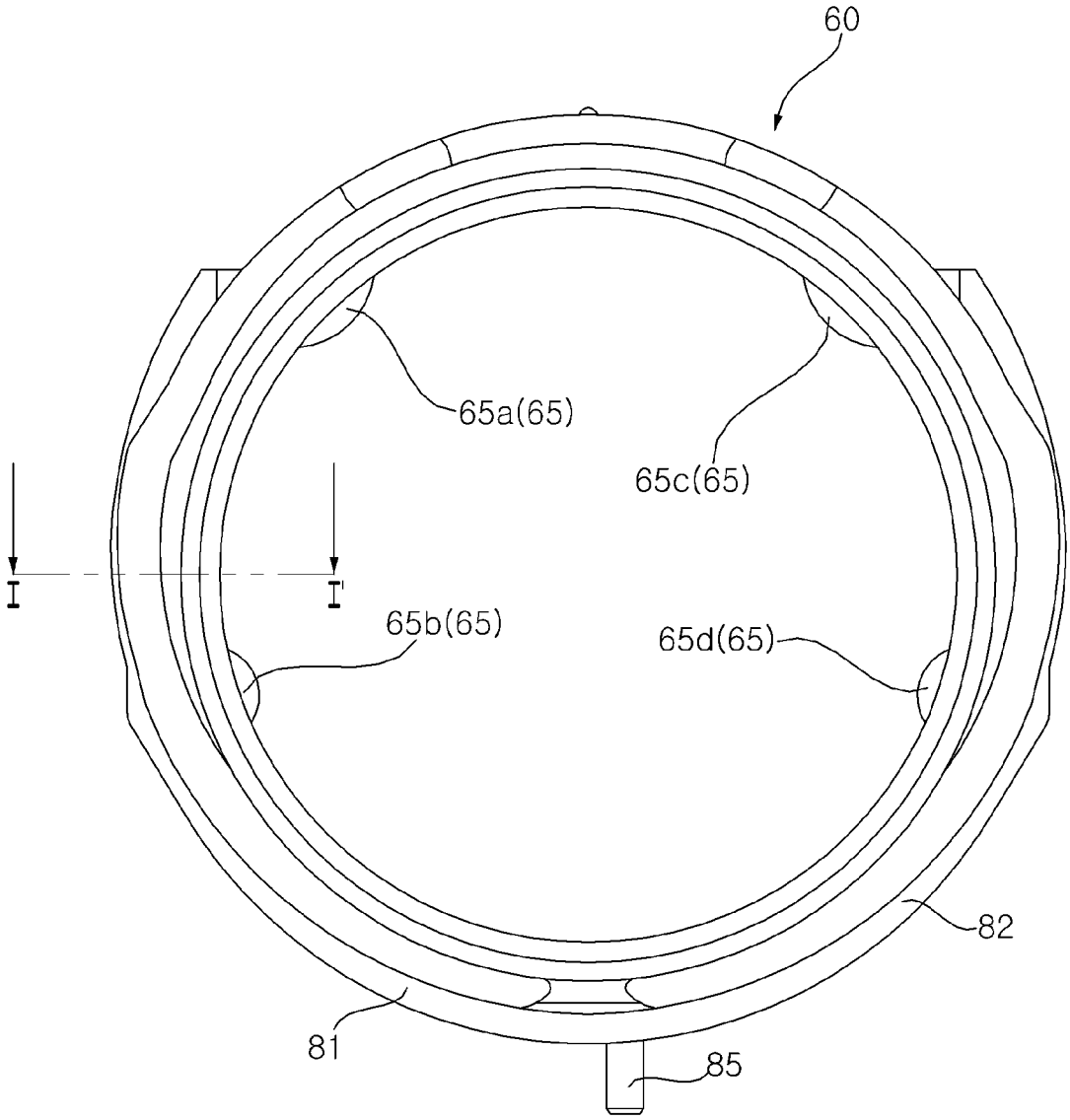
FIG. 7 is a front view of the assembly shown in FIG. 6.

Referring to FIGS. 6 and 7, the plurality of nozzle 66 and 67 may be provided in plural on the inner circumferential surface 62 of the gasket body 61 and 62. The plurality of nozzles 66 and 67 may include a plurality of upper nozzles 66*a* and 67*a*, and a plurality of lower nozzles 66*b* and 67*b* disposed lower than the upper nozzles 66*a* and 67*a*. The plurality of upper nozzles 66*a* and 67*a* may be disposed higher than the center O of the gasket 60, and the plurality of lower nozzles 66*b* and 67*b* may be disposed lower than the center O of the gasket 60.

In the case where the gasket body 61 and 62 is bilaterally divided into a first area and a second area, a plurality of nozzles 66 and 67 may include a first nozzle 66 disposed in the first area and a second nozzle 67 disposed in the second area. The first nozzle 66 may be disposed on the left side of the inner circumferential surface 62 of the gasket body, and the second nozzle 67 may be disposed on the right side of the inner circumferential surface 62 of the gasket body.

Each of the first nozzle 66 and the second nozzle 67 may be provided in plural. In the embodiment of the present invention, two first nozzles 66 and two second nozzles 67 are provided, but aspects of the present invention are not limited thereto.

The first nozzle 66 may include a first upper nozzle 66*a* and a first lower nozzle 66*b* that are vertically disposed in the first area. The first lower nozzle 66*b* may be disposed lower than the center O of the gasket 60, and the first upper nozzle 66*a* may be disposed higher than the first lower nozzle 66*b*. The first upper nozzle 66*a* may be disposed higher than the center O of the gasket 60.

The second nozzle 67 may include a second upper nozzle 67*a* ad a second lower nozzle 67*b* that are vertically disposed in the second area. The second lower nozzle 67*b* may be disposed lower than the center O of the gasket 60, and the second upper nozzle 67*a* may be disposed higher than the second lower nozzle 67*b*. The second upper nozzle 67*a* may be disposed higher than the center O of the gasket 60.

The first and second lower nozzles 66*b* and 67*b* may spray circulating water into the drum 40 in an upward direction. The first and second upper nozzles 66*a* and 67*a* may spray circulating water into the drum 40 in a downward direction. The circulating water refers to water that is discharged from the tub 30, pumped by the pump 70, guided to the distribution pipe 80, and sprayed into the drum 40 through the nozzle 66 and 67.

In the gasket 60, there may be provided a direct nozzle for spraying water into the drum 40, and a direct water supply pipe 18 for guiding water supplied through a water supply unit to the direct nozzle. The direct nozzle may be a whirl nozzle or a spray nozzle, but aspects of the present invention are not necessarily limited thereto. When viewed from the front, the direct nozzle may be disposed on a vertical line OV. A window 22 may protrude toward the drum 40 further than the direct nozzle. A water stream sprayed through the direct nozzle may touch the window 22, and, in this case, the effect of cleaning the window 22 may be achieved.

Figure 5:
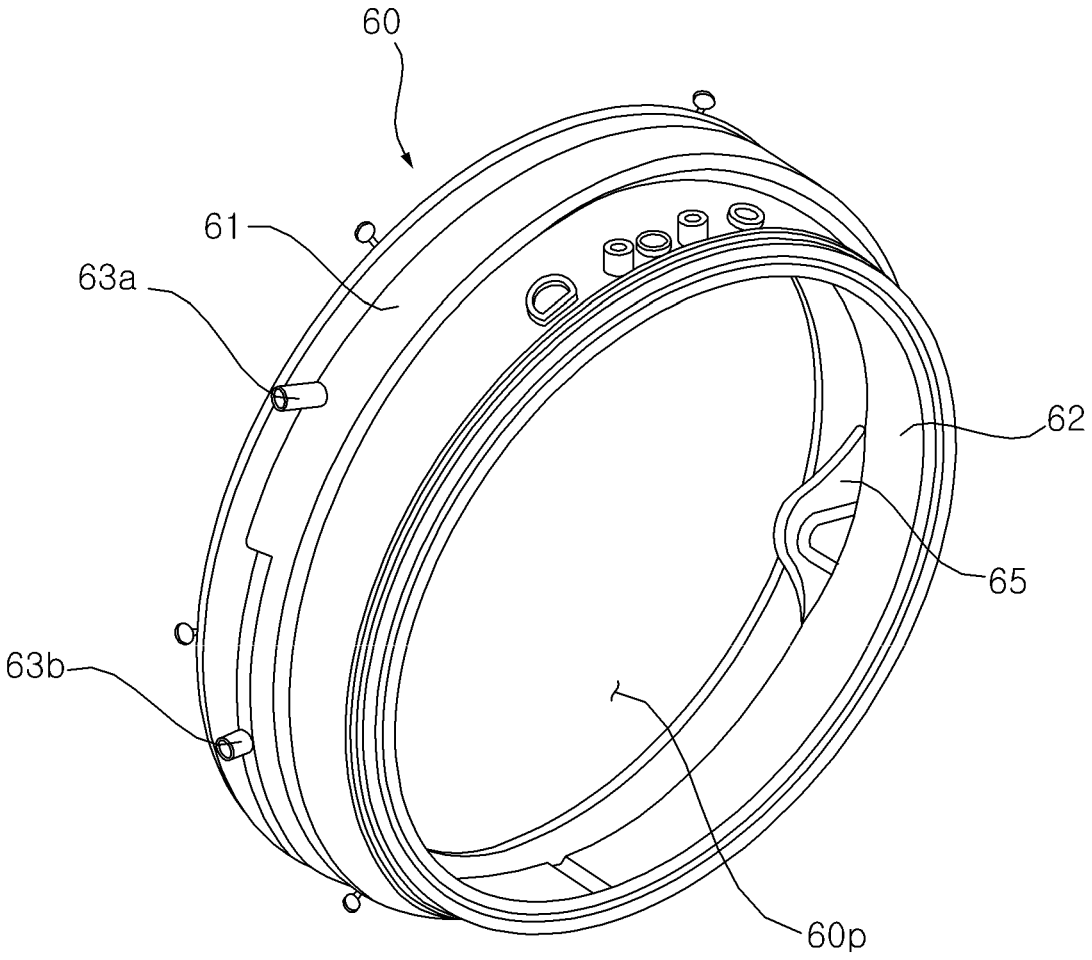
FIG. 5 is a perspective view of a gasket shown in FIG. 4.

Referring to FIGS. 5 and 6, the gasket 60 includes a plurality of port receiving pipes 63 and 64 communicating with the nozzle 66 and 67. The plurality of port receiving pipes 63 and 64 may be formed to protrude from the outer circumferential surface 61 of the gasket body. A plurality of outlet ports 83 and 84 described in the following are inserted into the plurality of port receiving pipes 63 and 64, and the plurality of port receiving pipes 63 and 64 is formed to protrude from the outer circumferential surface 61 of the gasket body, and accordingly, water supplied from the distribution pipe 80 to the plurality of nozzles 66 and 67 is prevented from leaking through between the plurality of port receiving pipes 62 and 63 and the plurality of outlet ports 83 and 84.

The plurality of port receiving pipes 63 and 64 may be in number corresponding to the number of the nozzles 66 and 67. In the case where the gasket body 61 and 62 is bilaterally divided into the first area and the second area, the plurality of port receiving pipes 63 and 64 may include a first port receiving pipe 63 disposed in the first area and a second port receiving pipe 64 disposed in the second area.

The first port receiving pipe 63 may communicate with the first nozzle 66, and the second port receiving pipe 64 may communicate with the second nozzle 67. The first port receiving pipe 63 may be disposed on the left side of the outer circumferential surface 61 of the gasket body, and the second port receiving pipe 64 may be disposed on the right side of the outer circumferential surface of the gasket body.

The first port receiving pipe 63 may include a first upper port receiving pipe 63*a* and a first lower port receiving pipe 63*b* that are vertically disposed in the first area. The first lower port receiving pipe 63*b* is disposed lower than the center O of the gasket 60, and the first upper port receiving pipe 63*a* may be disposed higher than the first lower port receiving pipe 63*b*. The first upper port receiving pipe 63*a* may be disposed higher than the center O of the gasket 60.

The first lower port receiving pipe 63*b* communicates with the first lower nozzle 66*b*, and the first upper port receiving pipe 63*a* communicate with the first upper nozzle 66*a*. The first upper port receiving pipe 63*a* and the first lower port receiving pipe 63*b* may protrude in directions parallel to each other.

The second port receiving pipe 64 may include a second upper port receiving pipe 64*a* and a second lower port receiving pipe 64*b* that are vertically disposed in the second area. The second lower port receiving pipe 64*b* is disposed lower than the center O of the gasket 60, and the second upper port receiving pipe 64*a* may be disposed higher than the second lower port receiving pipe 64*b*. The second upper port receiving pipe 64*a* may be disposed higher than the center O of the gasket 60.

The second lower port receiving pipe 64*b* communicates with the second lower nozzle 67*b*, and the second upper port receiving pipe 64*a* communicates with the second upper nozzle 67*a*. The second upper port receiving pipe 64*a* and the second lower port receiving pipe 64*b* may protrude in directions parallel to each other.

The upper nozzles 66*a* and 67*a* of the first and second nozzles 66 and 67, and the upper port receiving pipes 63*a* and 64*a* of the first and second port receiving pipes 63 and 64 may be disposed higher than a horizontal line OH passing through the center O of the gasket 60. The lower nozzles 66*b* and 67*b* of the first and second nozzles 66 and 67, and the lower port receiving pipes 63*b* and 64*b* of the first and second port receiving pipes 63 and 64 may be disposed lower than the horizontal line OH passing through the center O of the gasket 60.

In order to smoothly spray water toward laundry contained in the drum 40 and to uniformly spray water to any laundry item at any location in the drum 40, a distance between each of the lower nozzles 66*b* and 67*b* and the horizontal line OH passing through the center of the gasket 60 and between each of the lower port receiving pipes 63*b* and 64*b* and the horizontal line OH passing through the center of the gasket 60 may be smaller than a distance between each of the upper nozzles 66*a* and 67*a* and the horizontal line OH passing through the center of the gasket 60 and between each of the upper port receiving pipes 63*a* and 64*a* and the horizontal line OH passing through the center of the gasket 60.

Laundry received in the drum 40 is piled up at a lower side in the drum 40 due to the weight of gravity. In order to smoothly spray water into the laundry received in the drum 40, the lower nozzles 66*b* and 67*b* need to be disposed at a height spaced a considerable distance from the lowest point in the gasket 60. For example, an angle formed by each of the lower nozzles 66*b* and 67*b*, the center O of the gasket 60, and the lowest point in the gasket 60 may be 45° or greater. In addition, an angle formed by the lower port receiving pipes 63*b* and 64*b*, the center O of the gasket 60, and the lowest point in the gasket 60 may be 45° or greater.

In order to uniformly spray water to laundry received in the drum 40, the upper nozzles 66*a* and 67*a* need to be spaced a considerable distance from the lower nozzles 66*b* and 67*b*. For example, an angle formed by the upper nozzle 66*a* and 67*a*, the center O of the gasket 60, and the horizontal line OH passing through the center O of the gasket 60 may be 30° or greater. In addition, an angle formed by each of the upper port receiving pipes 63*a* and 64*a*, the center O of the gasket 60, and the horizontal line OH passing through the center O of the gasket 60 may be 30° or greater.

Referring to FIGS. 6 and 7, a plurality of protruding parts 65 may be formed in the inner circumferential surface 62 of the gasket at portion respectively corresponding to the plurality of port receiving pipes 63 and 64 to protrude inward, and the plurality of nozzles 66 and 67 may be formed at the protruding parts 65.

The protruding parts 65 may include a first protruding part 65*a*, a second protruding part 65*b*, a third protruding part 65*c*, and a fourth protruding part 65*d* protruding inwardly at portions that respectively correspond to the first upper and lower port receiving pipes 63*a* and 63*b* and the second upper and lower port receiving pipes 64*a* and 64*b*. The first upper and lower nozzles 66*a* and 66*b* and the second upper and lower nozzles 67*a* and 67*b* may be respectively formed at the first protruding part 65*a*, the second protruding part 65*b*, the third protruding part 65*c*, and the fourth protruding part 65*d*.

Referring to FIGS. 6 to 10, the distribution pipe 80 includes the transport conduit 81 and 82 for guiding water pumped by the pump 70, and the outlet ports 83 and 84 protruding from the transport conduit 81 and 82 toward the gasket body 61 and 62 and coupled to the port receiving pipe 63 and 64. In addition, the distribution pipe 80 may include an inlet port 85 introducing water discharged from the pump 70, and the transport conduit 82 may guide the water introduced through the inlet port 85 to the outlet ports 83 and 84.

The distribution pipe 80 may be inserted into the gasket 60 as the plurality of outlet ports 83 and 84 are inserted into the plurality of port receiving pipes 63 and 64. The transport conduit 81 and 82 of the distribution pipe 80 may be disposed on the outer circumferential surface 61 of the gasket body. At least a portion of the transport conduit 81 and 82 of the distribution pipe 80 may be disposed in the accommodation part 61 of the gasket 610, and the transport conduit 81 and 82 may be disposed in a space between the outer circumferential surface 61 of the gasket body and the balancer 90. Accordingly, the distribution pipe 80 may be installed without a need for an additional space.

The distribution pipe 80 may be formed of synthetic resin that is harder or stiffer than the gasket 60. The distribution pipe 80 maintains a predetermined shape in spite of vibration occurring during operation of the washing machine, and the distribution pipe 80 is relatively rigid compared to the gasket 60 that transforms in response to vibration of the tub 30.

In addition, the circulation pipe 86, which will be described later, may be flexible to transform in response to vibration of the tub 30. In this case, the distribution pipe 80 may be formed of synthetic resin harder or stiffer than the circulation pipe 86.

A distribution pipe 80 of a washing machine according to a first embodiment of the present invention may have an upper side 88 that is in an open ring shape. That is, the distribution pipe 80 may include an inlet port 85 introducing water pumped by the pump 70, one or more outlet ports 83 and 84 discharging the introduced water to be spayed into the drum 40 and a transport conduit 81 and 82 connecting the inlet port 85 and the outlet ports 83 and 84. One end of a left conduit 81 of the transport conduit 81 and 82 and one end of a right conduit 82 of the transport conduit 81 and 82 may be connected to each other at a point where the inlet port 85 is disposed, whereas the other end of the left conduit 81 and the other end of the right conduit 82 may be separated from each other.

The inlet port 85 may be formed at a lower side of the transport conduit 81 and 82 to protrude downward, and the outlet port 83 and 84 may be formed at each of the left and right parts of the distribution pipe 80 to protrude inwardly (or toward the gasket). The circulation pipe 86 may be disposed between the inlet port 85 and a circulation port 87 formed in the pump 70, so that wash water in the tub is introduced into the inlet port 85 through the circulation pipe 86.

A plurality of outlet ports 83 and 84 may include plurality of upper outlet ports 83*a* and 84*a* coupled to the upper port receiving pipe 63*a* and 64*a* of the gasket 60, and a plurality of lower outlet ports 83*b* and 84*b* coupled to the lower port receiving pipe 63*b* and 64*b* of the gasket 60. The plurality of upper outlet ports 83*a* and 84*a* and the plurality of lower outlet ports 83*b* and 84*b* may protrude from the transport conduit 81 and 82 toward the gasket body 61 and 62 in directions parallel to each other (which is in other words parallel directions). The plurality of upper outlet ports 83*a* and 84*a* and the plurality of lower outlet ports 83*b* and 84*b* may protrude in parallel with a horizontal line OH passing through the center O of the gasket.

The outlet ports 83 and 84 protrude from an inner surface of the transport conduit 81 and 82 (a surface facing the outer circumferential surface 61 of the gasket) toward the center of the gasket 60, and the outlet ports 83 and 84 are inserted into the port receiving pipes 63 and 64. The outlet ports 83 and 84 may guide circulating water, flowing along the transport conduit 81 and 82, to the nozzles 66 and 67 to be thereby sprayed into the drum 40.

A diameter of each of the outlet ports 83 and 84 may be formed a bit greater than an inner diameter of each of the port receiving pipes 63 and 64, so that the outlet ports 83 and 84 are inserted into the port receiving pipes 63 and 64. When the circulating water flows from the outlet ports 83 and 84 to the nozzles 66 and 67, a reaction force may be applied to sections of the transport conduit 81 and 82 in which the outlet ports 83 and 84 are disposed. In order to prevent separation of the distribution pipe 80 from the gasket 60 due to the reaction force, the port receiving pipes 63 and 64 may be formed to protrude outward from the outer circumferential surface 61 of the gasket 60 and a diameter of each of the outlet ports 83 and 84 may be formed a bit greater than an inner diameter of each of the port receiving pipe 63 and 64, as described above.

The outlet ports 83 and 84 includes a first outlet port 83, which protrudes from the left conduit part 81 of the transport conduit 81 and 82 in a direction toward a vertical line OV passing through the center O of the gasket 60, and a second outlet port 84, which protrudes from the right conduit part 82 of the transport conduit 81 and 82 in a direction toward the vertical direction OV passing through the center O of the gasket. The first outlet port 83 is inserted into the first port receiving pipe 63 to thereby guide circulating water to the first nozzle 66, and the second outlet port 84 is inserted into the second port receiving pipe 64 to thereby guide circulating water to the second nozzle 67.

The first outlet port 83 may include a first lower outlet port 83*b* inserted into the first lower port receiving pipe 63*b*, and a first upper outlet port 83*a* formed higher than the first lower outlet port 83*b* and inserted into the first upper port receiving pipe 63*b*. The second outlet port 84 may include a second lower outlet port 84*b* inserted into the second lower port receiving pipe 64*b* and a second upper outlet port 84*a* formed higher than the second lower outlet port 84*b* and inserted into the second upper port receiving pipe 64*b*.

The inlet port 85 is connected to the transport conduit 81 and 82 at a point lower than any of the plurality of outlet ports 83 and 84. The inlet port 85 is connected to the transport conduit 81 and 82 at a point lower than the plurality of lower outlet ports 83*b* and 84*b*.

The transport conduit 81 and 82 of the washing machine according to the first embodiment of the present invention is disposed on the outer circumferential surface 61 of the gasket body 61 and 62. The transport conduit 81 and 82 guides water introduced through an inlet port to the plurality of outlet ports 83 and 84.

The transport conduit 81 and 82 includes a first conduit part 81 forming the left side of the transport conduit 81 and 82 with reference to the inlet port 85, and a second conduit part 82 forming the right side of the transport conduit 81 and 82 with reference to the inlet port 85. The first conduit part 81 and the second conduit part 82 are connected at a lower side, and the inlet port 85 may protrude downward at the point where the first and second conduit parts are connected to each other.

The transport conduit 81 and 82 may branch water introduced through the inlet port 85 to the left and right sides and guide the water upwardly. The transport conduit 81 and 82 branches circulating water introduced through the inlet port 84 to thereby form a first sub-flow (water flowing along the first conduit part 81) and a second sub-flow (water flowing along the second conduit part 82). The first sub-flow may be sprayed into the drum 40 through the first nozzle 66, and the second sub-flow may be sprayed into the drum 40 through the second nozzle 67.

At least a portion of the transport conduit 81 and 82 may be disposed between the gasket body 61 and 62 and the balancer 90. The transport conduit 81 and 82 may be disposed in a manner in which an inner surface of the transport conduit 81 and 82 thereof opposes the outer circumferential surface 61 of the gasket body and an outer surface of the transport conduit 81 and 82 opposes the balancer 90.

Figure 10:
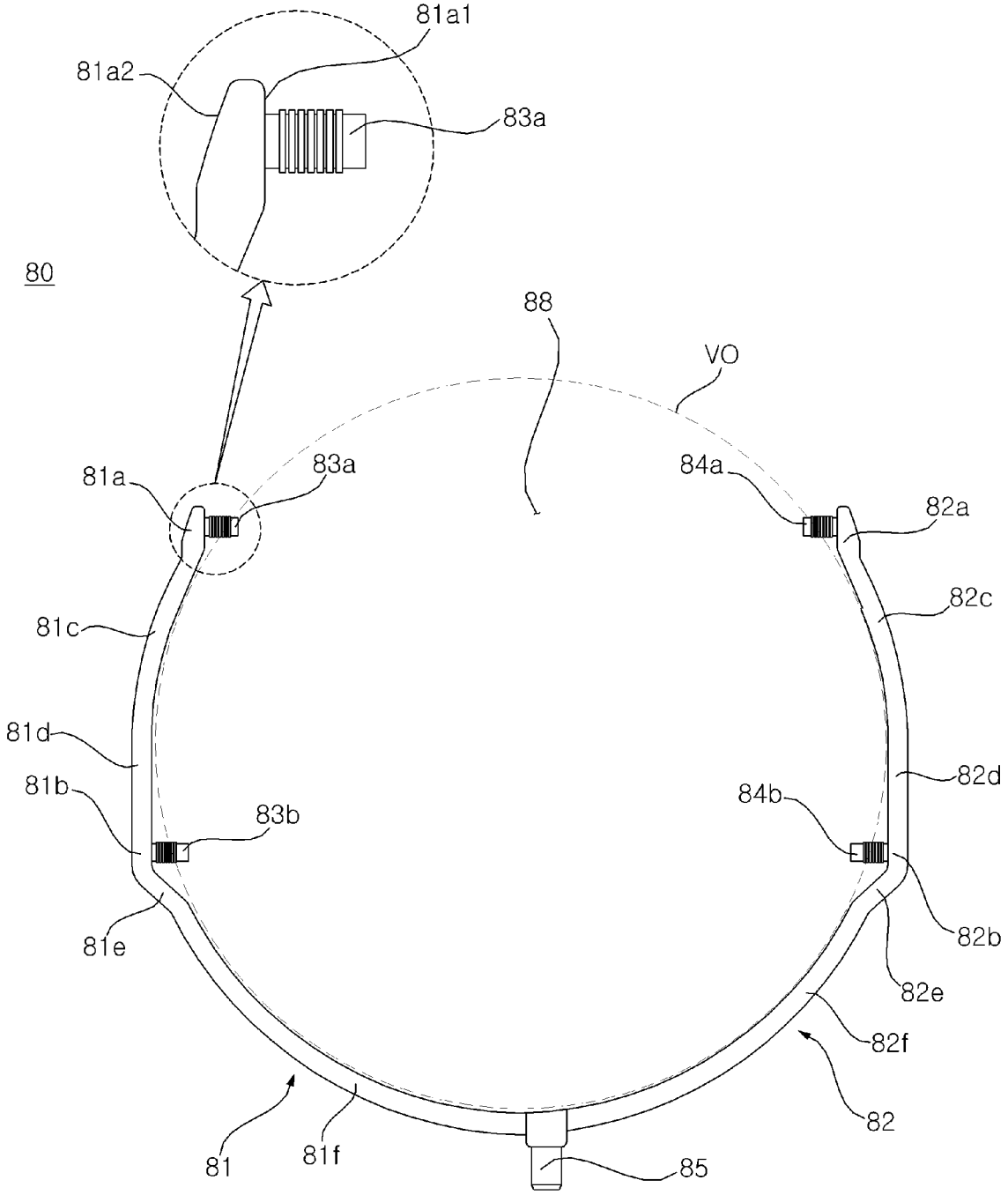
FIG. 10 is a front view of the distribution pipe shown in FIG. 4.

Referring to FIG. 10, the transport conduit 81 and 82 may be formed in an arc shape having a central angle of 180° or greater and an open upper side 88, and may be bilaterally symmetrical. The transport conduit 81 and 82 may include the first conduit part 81 disposed in the left side, and the second conduit disposed in the right side. The first conduit part 81 and the second conduit part 82 may be bilaterally symmetrical about the vertical line OV passing through the center O of the gasket 60.

The transport conduit 81 and 82 may be divided into port sections 81*a*, 82*b*, 82*b*, and 82*b*, in which where the outlet ports 83 and 84 (or exemplified as an outlet port 83), and guide sections 81*c* to 81*f* and 82*c* to 82*f*.

The outlet ports 83 and 84 protrude from the port sections 81*a*, 81*b*, 82*a*, and 82*b* in a direction toward the gasket body 61 and 62. The transport conduit 81 and 82 includes an inner surface opposing the outer circumferential surface 61 of the gasket body. The outlet ports 83 and 84 are disposed in inner surfaces of the port sections 81*a*, 81*b*, 82*a*, and 82*b* over the inner surface of the transport conduit 81 and 82. Hereinafter, the inner surfaces of the port sections The outlet ports 83 and 84 are disposed in inner surfaces of the port sections 81*a*, 81*b*, 82*a*, and 82*b* over the inner surface of the transport conduit 81 and 82 may be referred to as port surfaces 81*a*1, 81*b*1, 82*a*1, and 82*b*1.

The port sections 81*a*, 81*b*, 82*a*, and 82*b* include the port surfaces 81*a*1, 81*b*1, 82*a*1, and 82*b*1 from which the outlet ports 83 and 84 protrude. The port sections 81*a*, 81*b*, 82*a*, and 82*b* protrude from the port surfaces 81*a*1, 81*b*1, 82*a*1, and 82*b*1 toward the gasket body 61 and 62. The port surfaces 81*a*1, 81*b*1, 82*a*1, and 82*b*1 of the port sections 81*a*, 81*b*, 82*a*, and 82*b*, that is, port surfaces 81*a*1 and 82*a*1 of an upper port section 81*a* and 82*a* and port surfaces 81*b*1 and 82*b*1 of lower port sections 81*b* and 82*b*, may be formed to be parallel.

The port sections 81*a*, 81*b*, 82*a*, and 82*b* may include the upper port sections 81*a* and 82*a* and the lower port sections 81*b* and 82*b*. The guide sections 81*c* to 81*f* and 82*c* to 82*f* may include a lower guide section 81*f*, a bent section 81*e*, a middle guide section 81*d*, and an upper guide section 81*c*.

Hereinafter, the shape of the transport conduit 81 and 82 is described from an upper side to a lower side.

The transport conduit 81 and 82 (or exemplified as a transport conduit 81) includes: the upper port sections 81*a* and 82*a* (or exemplified as an upper port section 81*a*) where the upper outlet ports 83*a* and 84*b* (or exemplified as an upper outlet port 83*a*) are disposed; the upper guide sections 81*c* and 82*c* (or exemplified as an upper guide section 81*c*) disposed at a lower side of the upper port sections 81*a* and extending in an arc shape; middle guide sections 81*d* and 82*d* (or exemplified as a middle guide section 81*d*) disposed at a lower side of the upper guide sections 81*c* to be farther away from the outer circumferential surface 61 of the gasket 60 toward a lower side; lower port sections 81*b* and 82*b* (or exemplified as a lower port section 81*b*) disposed at a lower side the middle guide sections 81*d*; bent sections 81*e* and 82*e* (or exemplified as a bent section 81*e*) bent from the lower port section 81*b* to be more adjacent to the vertical line OV, passing through the center O of the gasket 60, toward a lower side; and lower guide sections 81*f* and 82*f* (or exemplified as a lower guide section 81*f*) extending from lower sides of the bent sections 81*e* in an arc shape.

Hereinafter, the shape of the transport conduit 81 and 82 will be described from a lower side to an upper side.

The transport conduit 81 and 82 includes the arc-shaped lower guide sections 81*f* and 82*f*. The inlet port 85 protrudes downward from the lower guide sections 81*f* and 82*f*, and the lower guide section 81*f* of the first guide part 81 and the lower guide section 82*f* of the second conduit part 82 are connected at a point where the inlet port 85 is disposed. The lower guide part 81*f* of the first conduit part 81 extends in an arc shape along an outer circumferential surface of the first area of the gasket body 61 and 62, and the lower guide section 82*f* of the second conduit part 82 extends in an arc shape along an outer circumferential surface of the second area of the gasket body 61 and 62. Water introduced through the inlet port 85 is branched to the left and right sides and then guided upward by the lower guide sections 81*f* and 82*f* of the first and second conduit parts 81 and 82.

The transport conduit 81 and 82 includes the bent sections 81*e* and 82*e* bent at the upper ends of the lower guide sections 81*f* and 82*f* in directions away from the gasket body 61 and 62. The upper ends of the lower guide sections 81*f* and 82*f*, and one ends of the bent sections 81*e* and 82*e* toward the lower guide sections 81*f* and 82*f* are in contact with the outer circumferential surface 61 of the gasket body, and the other ends of the lower guide sections 81*f* and 82*f* may be spaced apart from the outer circumferential surface 61 of the gasket body. Alternatively, a distance between each of the other ends of the lower guide sections 81*f* and 82*f* and the outer circumferential surface 61 of the gasket body may be greater than a distance between each of one ends of the bent sections 81*e* and 82*e* and the outer circumferential surface 61 of the gasket body.

The transport conduit 81 and 82 includes the lower port sections 81*b* and 82*b* spaced apart from the outer circumferential surface 61 of the gasket body. The above-described first and second portions refer to the lower port sections 81*b* and 82*b*. The lower port sections 81*b* and 82*b* extend upward from the bent sections 81*e* and 82*e* to be spaced apart from the outer circumferential surface 61 of the gasket body. The lower outlet ports 83*b* and 84*b* protrude from the lower port sections 81*b* and 82*b*. Accordingly, a space for coupling the lower outlet ports 83*b* and 84*b* and the lower port receiving pipes 63*b* and 64*b* is provided between the transport conduit 81 and 82 and the outer circumferential surface 61 of the gasket body.

At least a portion of the transport conduit 81 and 82 may include the upper port sections 81*a* and 82*a* spaced apart from the outer circumferential surface 61 of the gasket body. The upper ports 83*a* and 84*a* protrude from the upper port sections 81*a* and 82*a*.

As described above, the distance between each of the lower port receiving pipes 63*b* and 64*b* and the horizontal line OH passing through the center of the gasket is smaller than the distance between each of the upper port receiving pipes 63*a* and 64*a* and the horizontal line OH passing through the center of the gasket. Accordingly, the distance between each of the lower port receiving pipes 63*b* and 64*b* and the vertical line OV passing through the center O of the gasket body 61 and 62 is smaller than the distance between each of the upper port receiving pipes 63*a* and 64*a* and the vertical line OV. In response, the distance between each of the lower port sections 81*b* and 82*b* and the vertical line OV is greater than the distance between each of the upper port sections 81*a* and 82*a* and the vertical line OV.

The transport conduit 81 and 82 includes the middle guide sections 81*d* and 82*d* between the lower port sections 81*b* and 82*b* and the upper port sections 81*a* and 82*a*, and the upper guide sections 81*c* and 82*c*. The middle guide sections 81*d* and 82*d* extend upward from the lower port sections 81*b* and 82*b*. The middle guide sections 81*d* and 82*d* may extend from the lower port sections 81*b* and 82*b* to a height corresponding to the center O of the gasket body 61 and 62 and may extend in parallel with the vertical line OV passing through the center O of the gasket body 61 and 62.

The upper guide sections 81*c* and 82*c* may extend in an arc shape from the upper ends of the middle guide sections 81*d* and 82*d*. The upper guide sections 81*c* and 82*c* may extend in an arc shape from the upper ends of the middle guide sections 81*d* and 82*d* along the outer circumferential surface 61 of the gasket body.

The upper port sections 81*a* and 82*a* may be bent from the upper ends of the upper guide sections 81*c* and 82*c* in a direction away from the gasket body 61 and 62. Thus, even though the lower ends of the upper port sections are brought into contact with the outer circumferential surface 61 of the gasket body, at least a portion of the upper port sections 81*a* and 82*a* may be spaced apart from the outer circumferential surface 61 of the gasket body.

The upper port sections 81*a* and 82*a* may form the left and right upper ends of the transport conduit. An upper port section 81*a* of the first conduit part and an upper port section 82*a* of the second conduit part may be separated from each other. Thus, although a diameter of each of the outlet ports 83 and 84 is greater than an inner diameter of each of the port receiving pipes 63 and 64, the upper outlet ports 83*a* and 84*a* may be separated from the upper port receiving pipes 63*a* and 64*b*. The washing machine according to an embodiment of the present invention has the balancer 90 disposed external to the transport conduit 81 and 82 to thereby prevent separation of the distribution pipe 80. A detailed description thereof will be provided in the following.

As described above, the transport conduit 81 and 82 may include the first conduit part 81 disposed in the left side, and the second conduit part 82 disposed in the right side. The upper port section 81*a*, the upper guide section 81*c*, the middle guide section 81*d*, the lower port section 81*b*, the bent section 81*e*, and the lower guide section 81*f* included in the first conduit part 81 may be respectively referred to as a first upper port section 81*a*, a first upper guide section 81*c*, a first middle guide section 81*d*, a first lower port section 81*b*, a first bent section 81*e*, and a first lower guide section 81*f*. In addition, the upper port section 82*a*, the upper guide section 82*c*, the middle guide section 82*d*, the lower port section 82*b*, the bent section 82*e*, and the lower guide section 82*f* included in the second conduit part 82 may be respectively referred to as a second upper port section 82*a*, a second upper guide section 82*c*, a second middle guide section 82*d*, a second lower port section 82*b*, a second bent section 82*e*, and a second guide section 82*f*.

The port receiving pipes 63 and 64, the protruding parts 65, the nozzles 66 and 67, and the outlet ports 83 and 84 may vary in number and arrangement. In addition, the protruding parts 65 and the nozzles 66 and 67 may be omitted to spray water from the outer ports 83 and 84 into the drum 40, without. In addition, the nozzles 66 and 67 mat be formed separately from the gasket 60 to be coupled to or spaced apart from the gasket 60.

Meanwhile, referring to FIGS. 3 and 5, one end of the circulation pipe 86 is connected to the inlet port 85 protruding from the bottom of the distribution pipe 80, and the other end of the circulation pipe 86 may be connected to the circulation port 78 of the pump 70. In the case where the circulation port 78 of the pump 70 is formed at a position facing the inlet port along a straight line, the circulation pipe 86 may have a straight pipe shape. However, in other cases, the circulation pipe 86 may be formed as a hose made from a flexible substance or may be formed by bending. The circulation pipe 86 may be formed of a substance that is flexible but able to maintain a shape thereof. In the embodiment of the present invention, the circulation pipe 86*b* may be formed of ethylene propylene diene monomer rubber (EPDM). The circulation pipe 86 may include a bellows structure.

Figure 11:
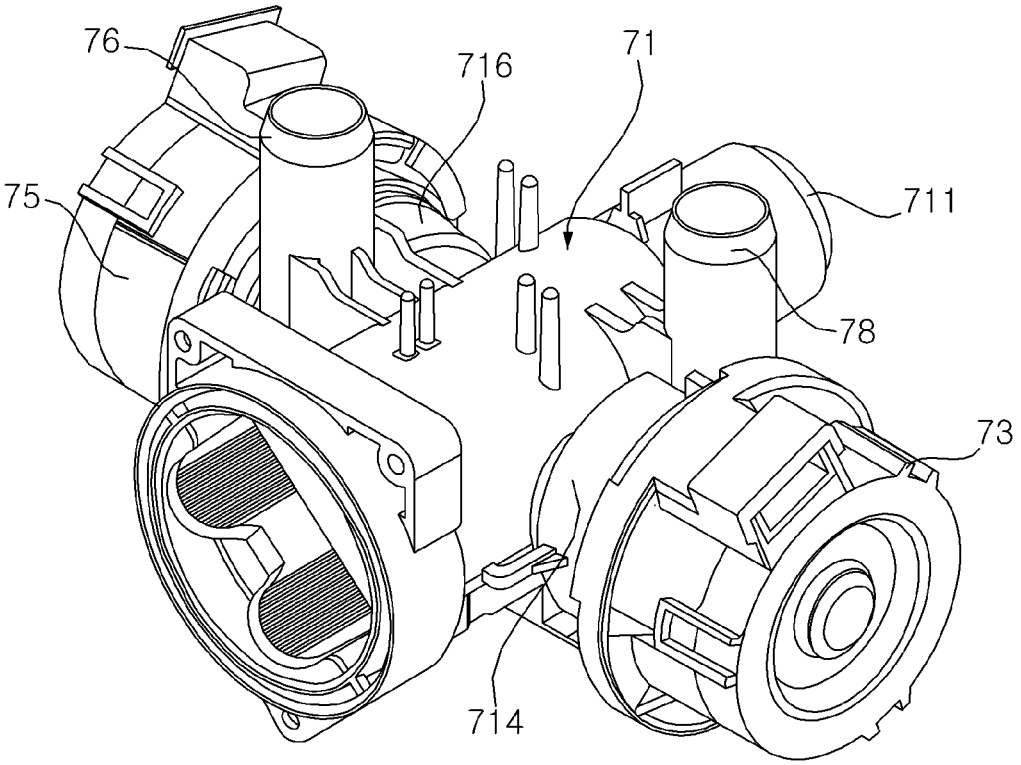
FIG. 11 is a perspective view of a pump shown in FIG. 4.
Figure 12A:
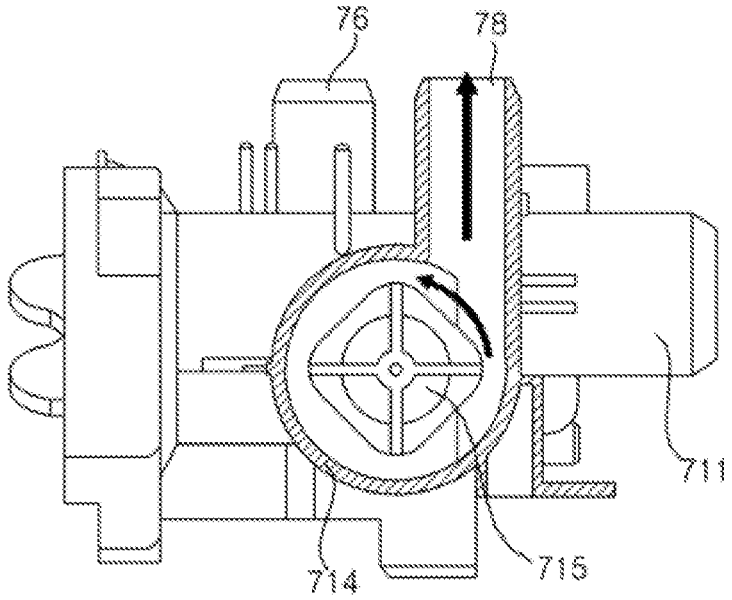
FIGS. 12A and 12B are side views of the pump shown in FIG. 11.
Figure 12B:
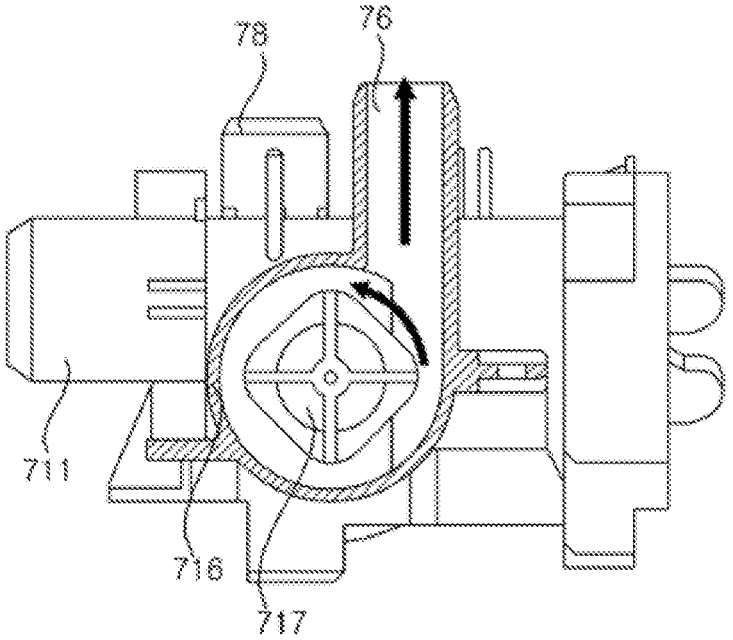
Figure 13:
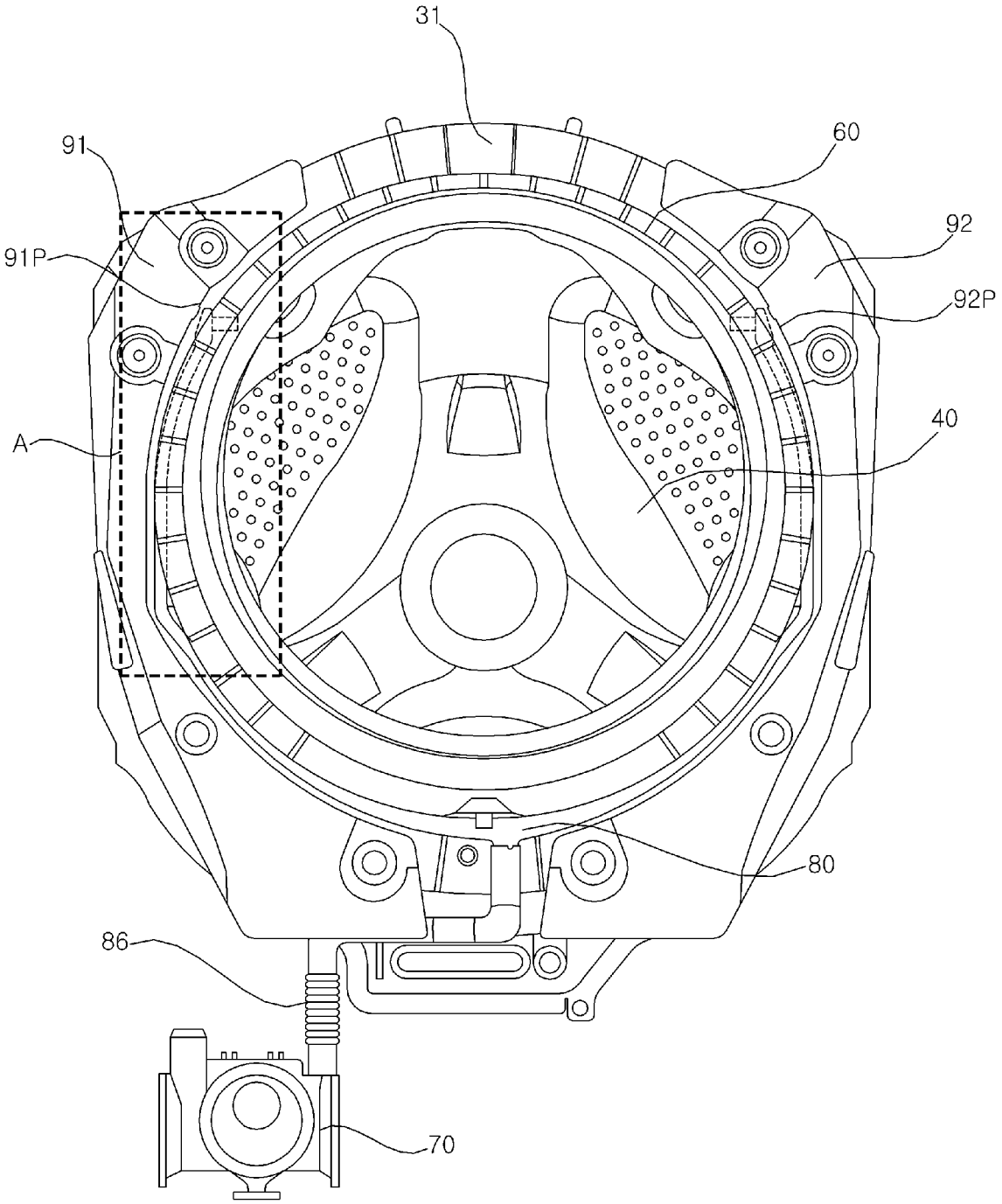
FIG. 13 is a front view of an assembly shown in FIG. 2.

Referring to FIGS. 11, 12, and 13, the pump 70 may selectively perform a function of pumping water discharged through the discharge hose 72 to the drain pipe 74, and a function of pumping water to the circulation pipe 86. The pump 70 may be disposed below the tub 30. The pump 70 may pump water discharged from the tub 30. As described above, water pumped by the pump, guided to the distribution pipe 80 along the circulation pipe 86, and then sprayed into the drum 40 is referred to as circulating water.

The pump 70 may include a pump housing 71, a first pump motor 73, a first impeller 715, a second pump motor 75, and a second impeller 717. The pump 70 may include a circulation port 78 and a drain port 76, which protrude from the pump housing 71 and discharges water discharged from the tub 70.

A pump inlet port 711 may be formed in the pump housing 71. In the pump housing 71, a first chamber 714 for accommodating the first impeller 715 and a second chamber 716 for accommodating the second impeller 717 may be formed. The first impeller 715 is rotated by the first pump motor 73, and a second impeller 717 may be rotated by the second pump motor 75.

The first chamber 716 and the circulation port 78 forms a flow path in a volute shape that is rolled in a direction of rotation of the first impeller 715. The second chamber 716 and the drain port 76 forms a flow path in a volute shape rolled in a direction of rotation of the second impeller 717. Here, the direction of rotation of each of the impellers 715 and 717 is controllable and predetermined. The pump inlet port 711 is connected to the discharge hose 74, and the first chamber 714 and the second chamber 716 communicate with the pump inlet port 711. Water discharged from the tub 30 through the discharge hose 74 is supplied to the first chamber 714 and the second chamber 716 through the pump inlet port 711.

The first chamber 715 communicates with the circulation port 78 and the second chamber 716 communicates with the drain port 76. Thus, when the first impeller 715 is rotated upon operation of the first pump motor 73, water contained in the first chamber 714 is discharged through the circulation port 78. In addition, if the second pump motor 75 operates, the second impeller 717 is rotated and accordingly water contained in the second chamber 716 is discharged through the drain port 76. The circulation port 78 is connected to the circulation pipe 86, and the drain port 76 is connected to the drain pipe 74.

Referring to FIGS. 3 and 4, the washing machine according to an embodiment of the present invention includes the balancer 90 disposed at the front surface 31 of the tub 30. The balancer 90 may be fastened to the front surface 31 of the tub 30. The balancer 90 is used to reduce vibration of the tub 30, and the balancer 90 is a weight body having a predetermined weight. The balancer 90 may include one or more balancers 90 disposed along a circumference of the front surface 31 of the tub 30.

A balancer 90 of a washing machine according to the first embodiment of the present invention may include a first balancer 91 and a second balancer 92 respectively disposed to the left and right sides of the front surface 31 of the tub 30. The first balancer 91 may be disposed to the left side of the gasket 60, and the second balancer 92 may be disposed to the right side of the gasket 60.

When the gasket body 61 and 62 is bilaterally divided into a first area and a second area, the first balancer 91 may be disposed external to the first area and the second balancer 92 may be disposed external to the second area.

The first balancer 91 and the second balancer 92 may be spaced apart from each other both at an upper side and at a lower side. The first and second balancers 91 and 91 may be in a bilaterally symmetrical shape about the vertical line OV passing through the center O of the gasket 60, and may be disposed at positions bilaterally symmetrical about the vertical line.

Figure 14:
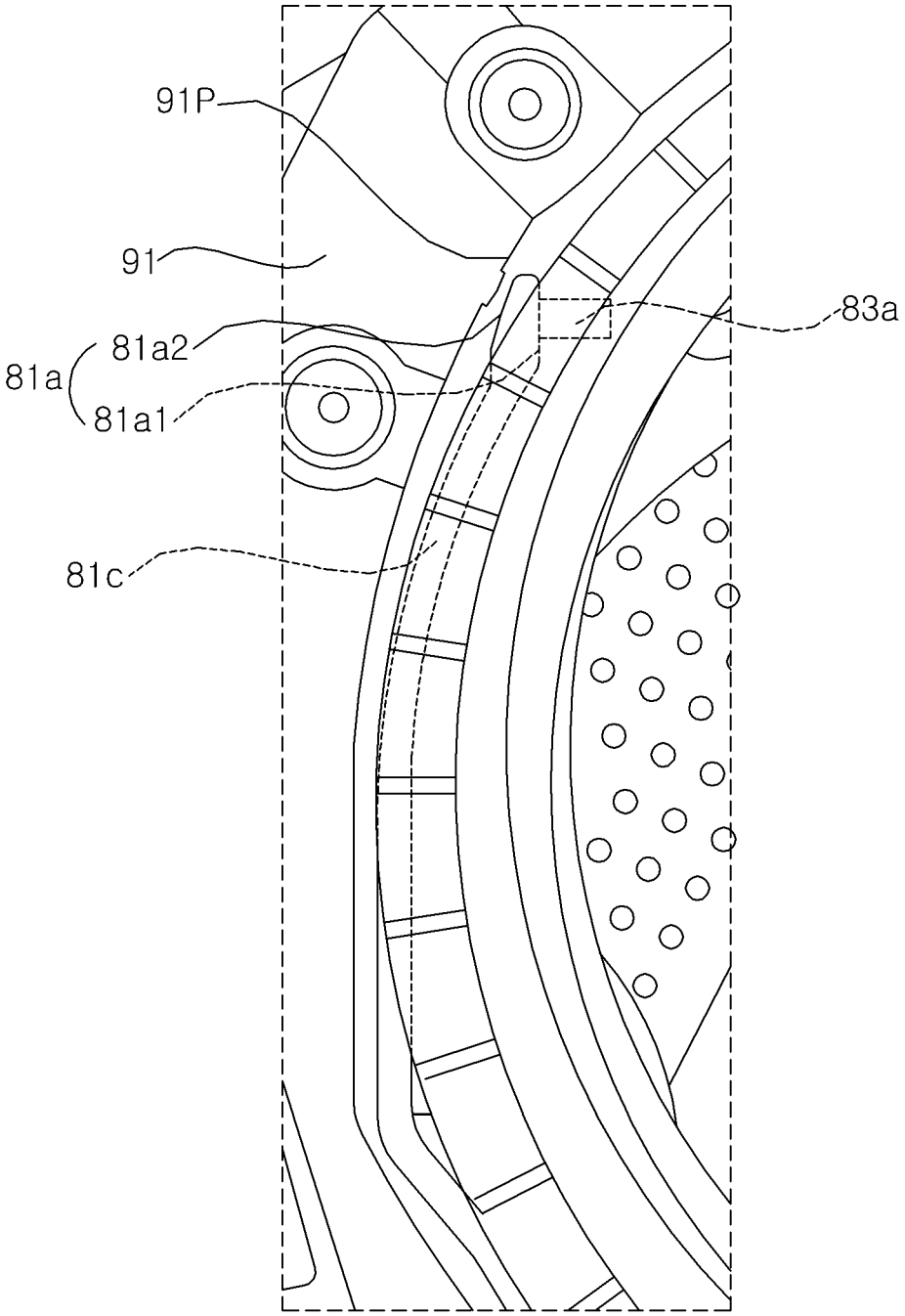
FIG. 14 is an enlarged view of a portion A shown in FIG. 13.
Figure 15:
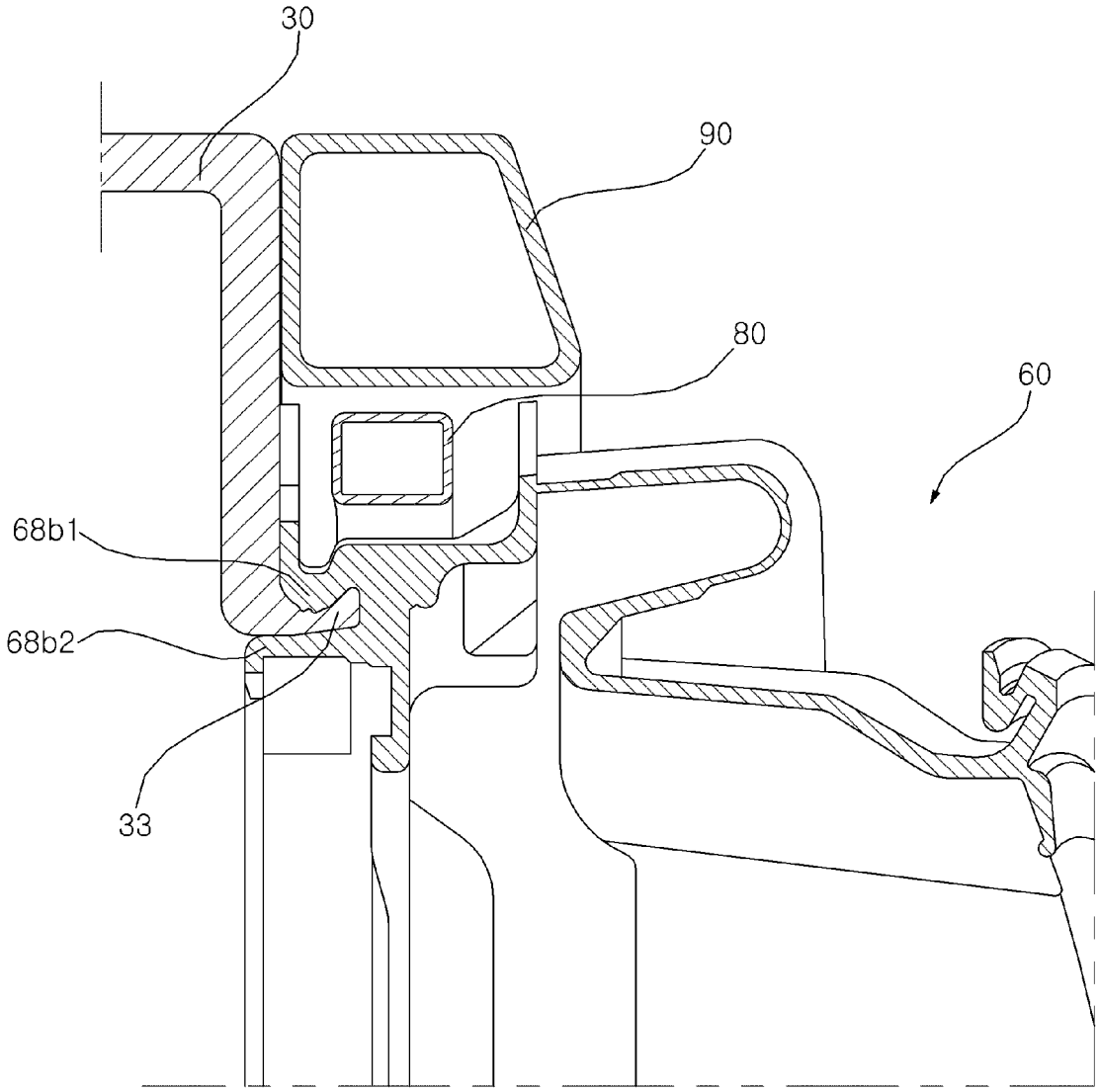
FIG. 15 is a cross-sectional view of how an assembly, a tub, and a balancer shown in FIG. 9 are coupled.

Hereinafter, referring to FIGS. 13, 14, and 15, arrangement of the gasket 60, the distribution pipe 80, and the balancer 90 will be described.

At least a portion of the balancer 90 is spaced apart from the outer circumferential surface 61 of the gasket body 61 and 62. At least a portion of the transport conduit 81 and 82 is disposed in a space between the outer circumferential surface 61 of the gasket body 61 and 62 and the balancer 90. At least a portion of each of the first balancer 81 and the second balancer 82 is spaced apart from the outer circumferential surface of the gasket body. At least a portion of the first conduit part 81 is disposed in a space between the outer circumferential surface 61 of the first area and the first balancer 91, and at least a portion of the second conduit part 82 is disposed in a space between the outer circumferential surface 61 of the second area and the second balancer 92.

The first balancer 91 and the second balancer 92 may be bilaterally symmetrical. Thus, the first balancer 91, the distribution 80, and the left side of the gasket 60 will be hereinafter described, and a description about the second balancer 92, the distribution pipe 80, and the right side of the gasket 60 will be partially omitted.

An upper port section 81*a*, an upper guide section 81*c*, a middle guide section 81*d*, and a lower port section 81*b* of the transport conduit 81 are disposed in a space were the first balancer 91 and the outer circumferential surface 61 of the gasket body are spaced apart from each other. A bent section 81*e* may be disposed in a space between the first balancer 91 and the outer circumferential surface 61 of the gasket body. A portion (an upper portion) of a lower guide section 81*f* may be disposed in a space between the first balancer 91 and the outer circumferential surface 61 of the gasket body.

Accordingly, the first balancer 91 may be disposed external to the first area, and extend from above the first upper port section 81*a* to below the first lower port section 81*b*. The second balancer 92 may be disposed external to the second area, and extend from above a second upper port section 82*a* to below a second lower port section 82*b*.

The balancer 90 may include a position limiting part 90*p* that prevents separation of the upper outlet port 83*a* and 84*b* from the upper port receiving pipes 63*a* and 64*a*. A position limiting part of the first balancer 91 is referred to as a first position limiting part 91*p*, and a position limiting part of the second balancer 92 is referred to as a second position limiting part 92*p*. The first position limiting part 91*p* may be provided at a location corresponding to the first upper port section 81*a*. The first position limiting part 91*p* may be spaced apart from the outer circumferential surface 61 of the gasket body. The first position limiting part 91*p* may be spaced apart in an outer direction from the outer circumferential part 61 of the gasket body.

The first upper port section 81*a* of the transport conduit 81 may be disposed in a space between the outer circumferential surface 61 of the gasket body and the first position limiting part 91*p*. By adjusting an interval between the first position limiting part 91*p* and the outer circumferential surface of the gasket body or an interval between the first position limiting part 91*p* and the first upper port section 81*a*, it is possible to prevent separation of the first upper outlet port 83*a* from the first upper port receiving pipe 63*a*.

The transport conduit 81 and 82 includes an inner surface opposing the outer circumferential surface 61 of the gasket body, and an outer surface opposite to the inner surface. The balancer 90 includes an inner surface opposing the outer circumferential surface 61 of the gasket body. An outer surface of at least a portion of the transport conduit 81 and 82 opposes the inner surface of the balancer 90.

The upper port sections 81*a* and 82*a* may include port surfaces 81*a*1 and 82*a*1, where the upper outlet ports 83*a* and 84*a* are disposed, and supporting surfaces 81*a*2 and 82*a*2 opposite to the port surfaces 81*a*1 and 82*a*1. That is, the transport conduit 81 and 82 includes an inner surface of the gasket body 61 and 62, and an outer surface of the balancer 90. The supporting surfaces 81*a*2 and 82*a*2 refer to the outer surface of the upper port sections 81*a* and 82*a*.

Hereinafter, a port surface 81*a*1 and a supporting surface 81*a*2 of the first upper port section 81*a* are respectively referred to as a first upper port surface 81*a*1 and a first supporting surface 81*a*2, and a port surface 82*a*1 and a supporting surface 82*a*2 of the second upper port section 82*a* are respectively referred to as a second upper port surface 82*a*1 and a second supporting surface 82*a*2.

The first position limiting part 91*p* of the first balancer 91 may come into contact with the first supporting surface 81*a*2. Alternatively, the first balancer 91 may be disposed in such a way that an interval between the first position limiting part 91*p* and the first supporting surface 81*a*2 is shorter than a length L by which the first upper outlet port 83*a* is inserted into the first upper port receiving pipe 63*a*.

The first supporting surface 81*a*2 may come into contact with the first position limiting part 91*p*. Alternatively, the first supporting surface 81*a*2 may be spaced apart from the first position limiting part 91*p*, and an interval between the first supporting surface 81*a*2 and the first position limiting part 91*p* may be shorter than the length L by which the first upper outlet port 83*a* is inserted into the first upper port receiving pipe 63*a*.

The second position limiting part 92*p* of the second balancer 92 may come into contact with the second supporting surface 82*a*2. Alternatively, the second balancer 92 may be disposed in such a way that an interval between the second position limiting part 92*p* and the second supporting surface 82*a*2 is shorter than a length L by which the first upper outlet port 84*a* is inserted into the first upper port receiving pipe 64*a*.

The second supporting surface 82*a*2 may come into contact with the second position limiting part 92*p*. Alternatively, the second supporting surface 82*a*2 may be spaced apart from the second position limiting part 92*p*, and an interval between the second supporting surface 82*a*2 and the second position limiting part 92*p* may be shorter than the length L by which the second upper outlet port 84*a* is inserted into the second upper port receiving pipe 64*a*.

Accordingly, it is possible to prevent separation of the upper outlet ports 83*a* and 84*a* from the upper port receiving pipes 63*a* and 64*a*.

The balancer 90 may be disposed external the gasket 61 and 62, and the inner surface of the balancer 90 may be formed in a convex shape and surround a portion of the outer circumferential surface 61 of the gasket body. The first balancer 91 may surround a portion of the first area, and the second balancer 92 may surround a portion of the second area.

The first and second position limiting parts 91*p* and 92*p* may be provided at locations corresponding to the first and second upper outlet ports 83*a* and 84*a*, respectively, and the first and second upper outlet ports 83*a* and 84*a* may be disposed higher than the center O of the gasket body 61 and 62. Accordingly, the inner surfaces of the first and second position limiting parts 91*p* and 82*p* may be inclined in a direction to be farther away from a vertical line OV, passing through the center O of the gasket body 61 and 62, from an upper side toward a lower side.

The first supporting surface 81*a*2, which is the outer surface of the first upper port section 81*a*, and the inner surface of the first position limiting part 91*p* oppose each other. The second supporting surface 82*a*2, which is the outer surface of the second upper port receiving section 82*a*, the inner surface of the second position limiting part 92*p* opposes each other. Accordingly, the first and second supporting surface 81*a*2 and 82*a*2 may be inclined in a direction to be farther away from the vertical line OV from an upper side toward a lower side.

Meanwhile, the first position limiting part 91*p* may include a protrusion, which is formed in the inner surface of the first position limiting part 91*p* and protrudes toward the first upper port section 81*a* or 82*a* or toward the gasket body 61 and 62. The protrusion of the first position limiting part 91*p* may come into contact with the first supporting surface 81*a*2, which is the outer surface of the first upper port section 81*a*. In addition, the inner surface of the second position limiting part 92*p* may include a protrusion, which is formed in the inner surface of the second position limiting part 92*p* and protrudes toward the second upper port section

82*a* or toward the gasket body 61 and 62. The protrusion of the second position limiting part 92*p* may come into contact with the second supporting surface 82*a*2.

The first supporting surface 81*a*2 of the first upper port section 81*a*, and the inner surface of the first position limiting part 91*p* of the first balancer 91 opposing the first supporting surface 81*a*2 are inclined in the same direction. The second supporting surface 82*a*2 and the inner surface of the second position limiting part 92*p* are inclined in the same direction. Accordingly, the balancer 90 may stably support the distribution pipe 80, and separation of the distribution pipe 80 from the gasket 60 may be prevented.

Meanwhile, the balancer 90 has an advantage of preventing the separation of the distribution pipe 80 in use of the washing machine. However, when the washing machine needs to be repaired, the balancer 90 may make it difficult to separate the distribution pipe 80 from the gasket 60.

The lower outlet ports 83*b* and 84*b* may be disposed lower than the upper outlet ports 83*a* and 84*a*. The position limiting parts 91*p* and 92*p* prevents that an interval between upper ends of the lower outlet ports 83*b* and 84*b* is increased. Thus, although the lower port sections 81*b* and 82*b* are not supported by the balancer, the lower outlet ports 83*b* and 84*b* are less likely to be separated from the lower port receiving pipes 63*b* and 64*b*. Accordingly, the inner surface of the balancer 90 and the outer surface of each of the lower port sections 81*b* and 82*b* may be spaced apart from each other.

An interval between each of the lower port sections 81*b* and 82*b* and the balancer 90 may be greater than an interval between each of the upper port sections 81*a* and 82*a* and the balancer 90. That is, the outer surface of the first lower port section 81*b* and the inner surface of the first balancer 91 may be greater than an interval between the first supporting surface 81*a*2 and the first position limiting part 91*p*. The outer surface of the second lower port section 82*b* and the inner surface of the second balancer 92 may be greater than an interval between the second supporting surface 82*a*2 and the second position limiting part 92*p*.

In addition, the gasket 60 may be formed of a flexible substance, and thus, although the interval between each of the lower port sections 83*b* and 84*b* and the balancer 90 is a bit smaller than a length by which the lower outlet ports 83*b* and 84*b* are inserted into the lower port receiving pipes 63*b* and 64*b*, it is possible to forcibly separate the lower outlet ports 83*b* and 84*b* from the lower port receiving pipes 63*b* and 64*b*.

Accordingly, when the washing machine needs to be repaired, it is possible to separate the lower outlet ports 83*b* and 84*b* from the lower port receiving pipes 63*b* and 64*b*, without separating the balancer 90 from the tub 30, and then separate the upper outlet ports 83*a* and 84*a* from the upper port receiving pipes 63*a* and 64*a*.

Figure 16:
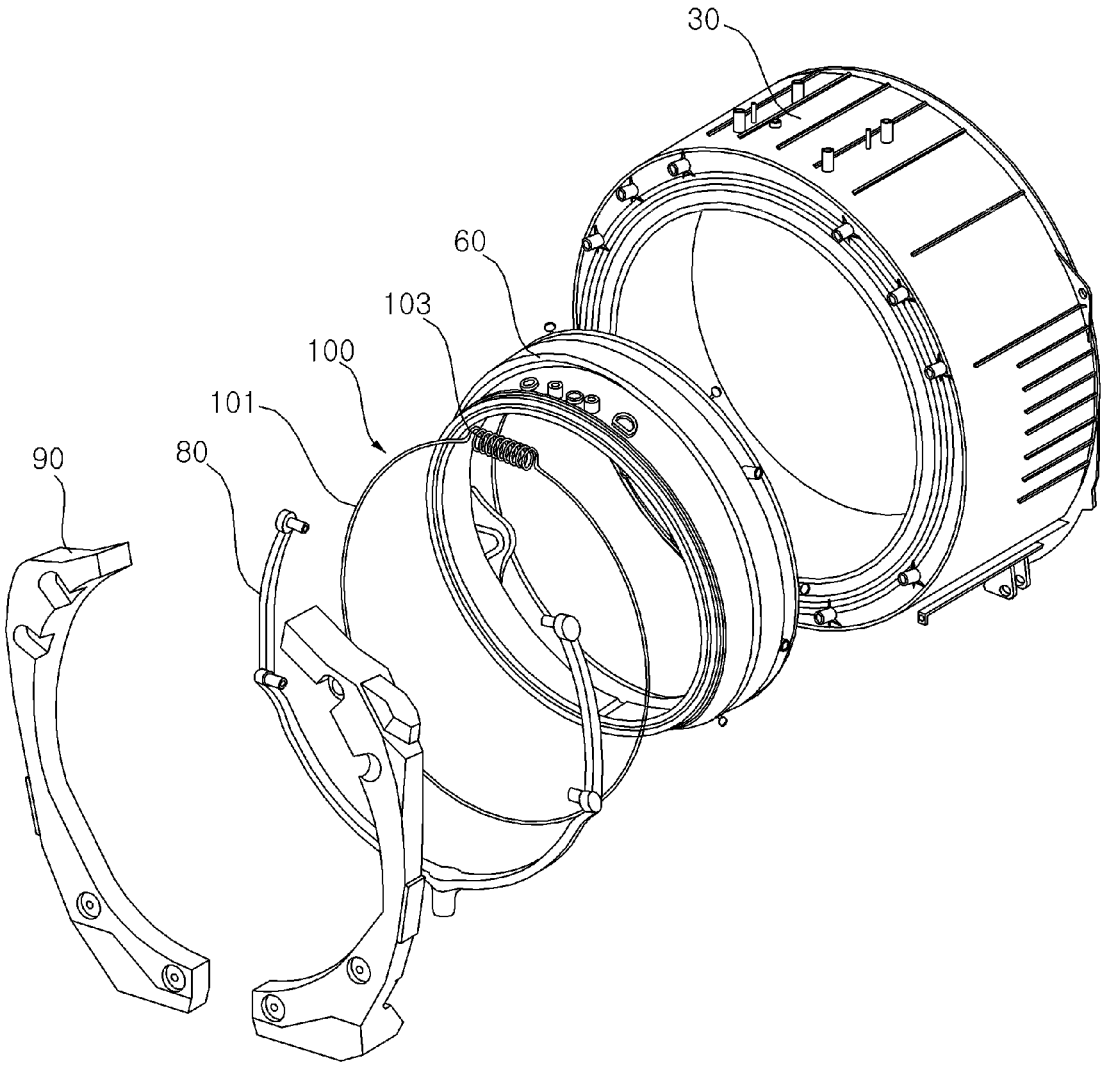
FIGS. 16 and 17 are exploded perspective view illustrating a method for assembling components shown in FIG. 4.
Figure 17:
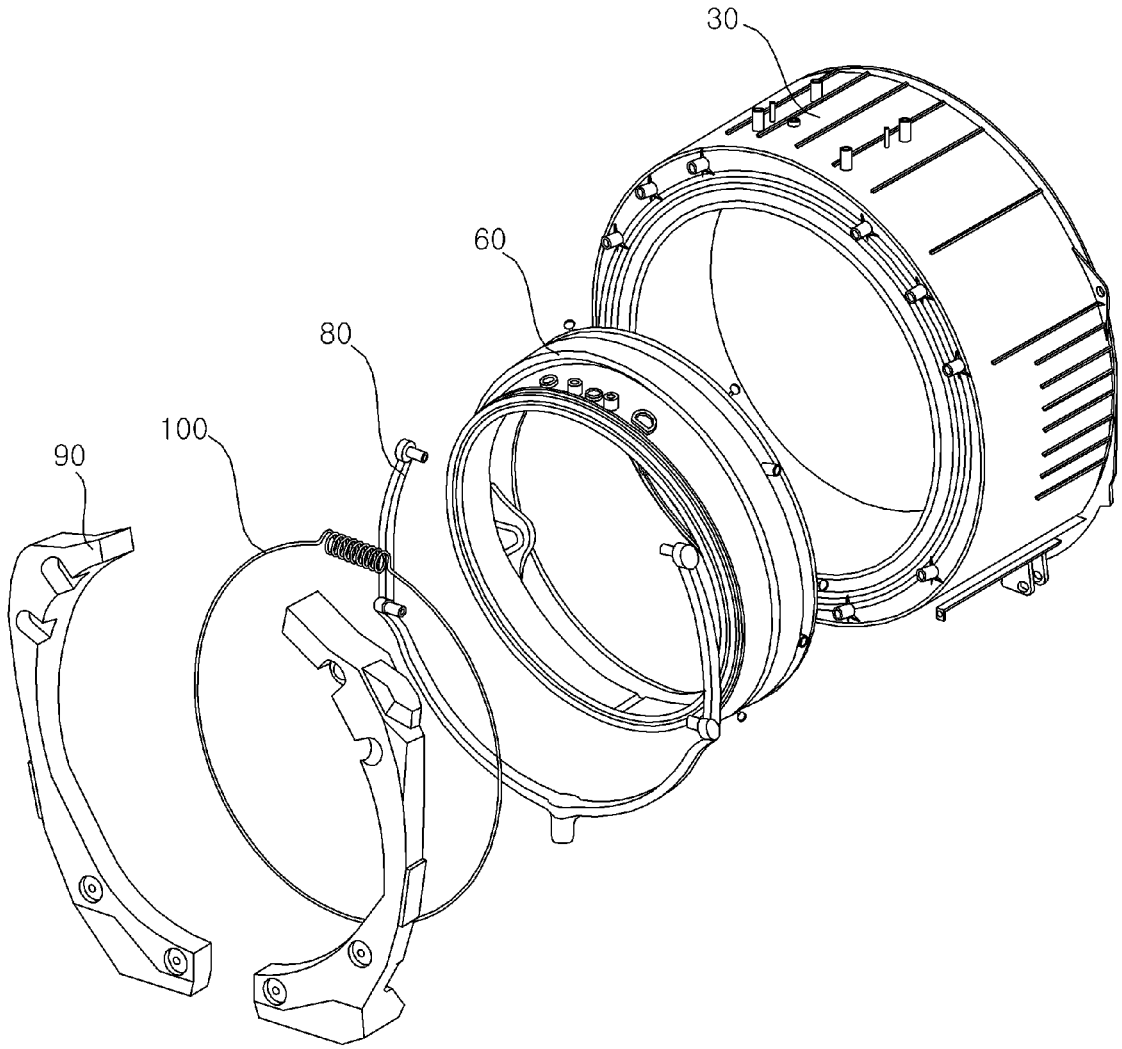

Hereinafter, referring to FIGS. 16 and 17, a method for assembling a washing machine according to a first embodiment of the present invention will be described.

First, a gasket 60 is assembled with a front surface 31 of a tub 30. The tub 30 includes an entrance hole circumference 33 that defines an opening 32. The gasket 60 may include a tub coupling part 68*b* that is recessed along the entrance hole circumference 33.

The tub coupling part 68*b* includes an outer tub coupling part 68*b*1 protruding from a rear end of a gasket body 61 and 62, and an inner tub coupling part 68*b*2. The outer tub coupling part 68*b*1 protrudes from an outer side further than the inner tub coupling part 68*b*2, and a groove into which the tub entrance circumference 33 is inserted is formed between the outer tub coupling part 68*b*1 and the inner tub coupling part 68*b*2.

The inner tub coupling part 68*b*2 extends rearward from a rear end of the gasket body 61 and 62 and is then bent inward. The outer tub coupling part 68*b*1 protrudes from a rear end of the gasket body 61 and 62 and bent inward and then bent outward.

The entrance hole circumference 33 of the tub 30 protrudes from the front surface 31 and is bent outward. The outwardly bent portion of the entrance hole circumference 33 is engaged with the inwardly bent portion of the outer tub coupling part 68*b*1. When the front surface 31 of the tub 30 is to be assembled with the gasket 60, the entrance hole circumference 33 is fitted into the groove formed between the outer tub coupling part 68*b*1 and the inner tub coupling part 68*b*2.

Although the entrance hole circumference 33 of the tub 30 and the tub coupling part 68*b* of the gasket 60 are coupled, there are possibilities that the gasket 60 can be separated due vibration of the tub 30 and that wash water contained in the tub 30 can leak through an interval between the entrance hole circumference 33 and the tub coupling part 68*b*. Therefore, it is necessary to more tightly fix the gasket 60 to the tub 30.

The gasket 60 is assembled with the front surface of the tub 30 and fixed using an annular clamp 100. The outer tub coupling part 68*b*2 is bent inward and the bent outward to form a groove in the outside, the groove into which the clamp is inserted.

The clamp 100 includes an arc-shaped clamp wire 101 of which both ends are open, and a spring 103 which elastically connects the both ends of the clamp wire 101. The clamp wire 101 is placed in the groove formed in the outward tub coupling part 68*b*1 and the spring 103 is bound to the both ends of the clamp wire 101 to thereby fix the gasket 60 to the tub 30.

The gasket 60 is fixed to the tub 30 using the clamp 100, and the distribution pipe 80 is assembled with the gasket 60 assembled with the tub 30. The distribution pipe 80 may be assembled with the gasket 60 by inserting a plurality of outlet ports 83 and 84 into a plurality of port receiving pipes 63 ad 64 protruding from an outer circumferential surface 61 of the gasket body. A transport conduit 81 and 82 of the distribution pipe 80 may be disposed on the outer circumferential surface 61 of the gasket body.

A diameter of the outlet port 83 or 84 is a bit greater than an inner diameter of the port receiving pipe 63 or 64, so that the outlet port 83 or 84 can be press-fitted into the port receiving pipe 63 or 64.

Meanwhile, on the contrary to the above description, the gasket 60 may be assembled with the tub 30, the distribution pipe 80 may be assembled with the gasket 60 assembled with the tub 30, and the gasket 60 assembled with the distribution pipe 80 may be assembled with the tub 30 using the clamp 100.

The gasket 60 may be fixed to the tub 30, the distribution pipe 80 may be assembled with the gasket 60, and the balancer 90 may be fastened to the front surface 31 of the tub 30. The balancer 90 may be disposed external to the outer circumferential surface 61 of the gasket body. In addition, the balancer 90 may be disposed external to the transport conduit 81. That is, the transport conduit 81 may be disposed between the outer circumferential surface 61 of the gasket body and the balancer 91.

The balancer 90 includes position limiting parts 91*p* and 92*p* that prevent separation of the distribution pipe 80 from the gasket 60. The position limiting part 91*p* and 92*p* may be disposed to be in contact with supporting surfaces 81*a*2 and 82*a*2 that are outer surfaces of the upper port sections 81*a* and 82*a* of the transport conduit 81 and 82. Alternatively, the balancer 90 may be disposed in such a way that the position limiting parts 91*p* and 92*p* are spaced apart from the supporting surfaces 81*a*2 and 82*a*2 of the transport conduit 81 and 82. The interval between the position limiting parts 91*p* and 92*p* are spaced apart from the supporting surfaces 81*a*2 and 82*a*2 of the transport conduit 81 and 82 may be shorter than a length by which a first outlet port 83*a* is inserted into a first upper port receiving pipe 63*a*.

By assembling the balancer finally among the gasket 60, the clamp 100, the distribution pipe 80, and the balancer 90, it is possible to easily assembly the tub 30, the gasket 60, the clamp 100, the distribution pipe 80, and the balancer 90.

Figure 18:
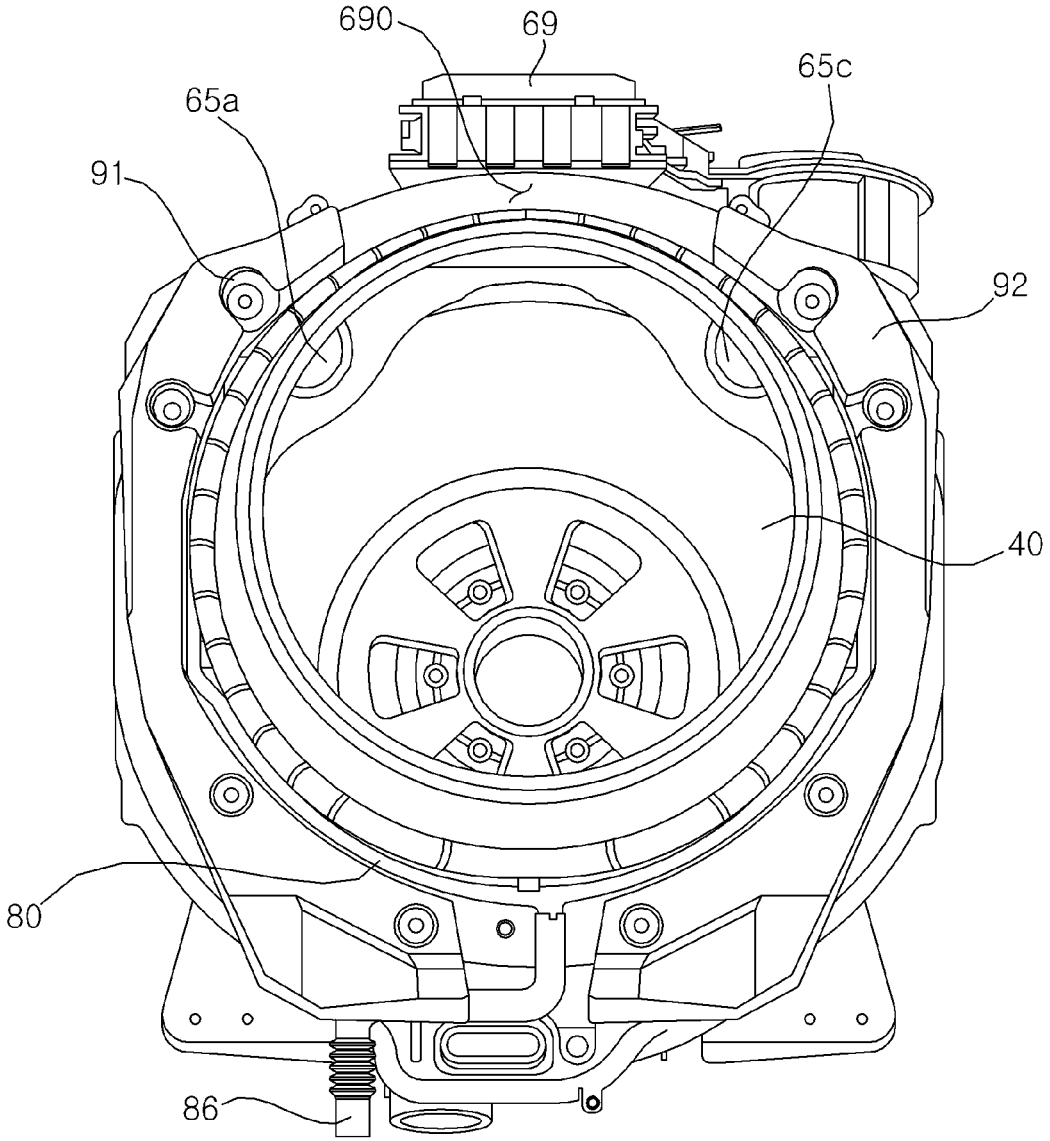
FIG. 18 illustrates a portion of a washing machine according to a second embodiment of the present invention.
Figure 19:
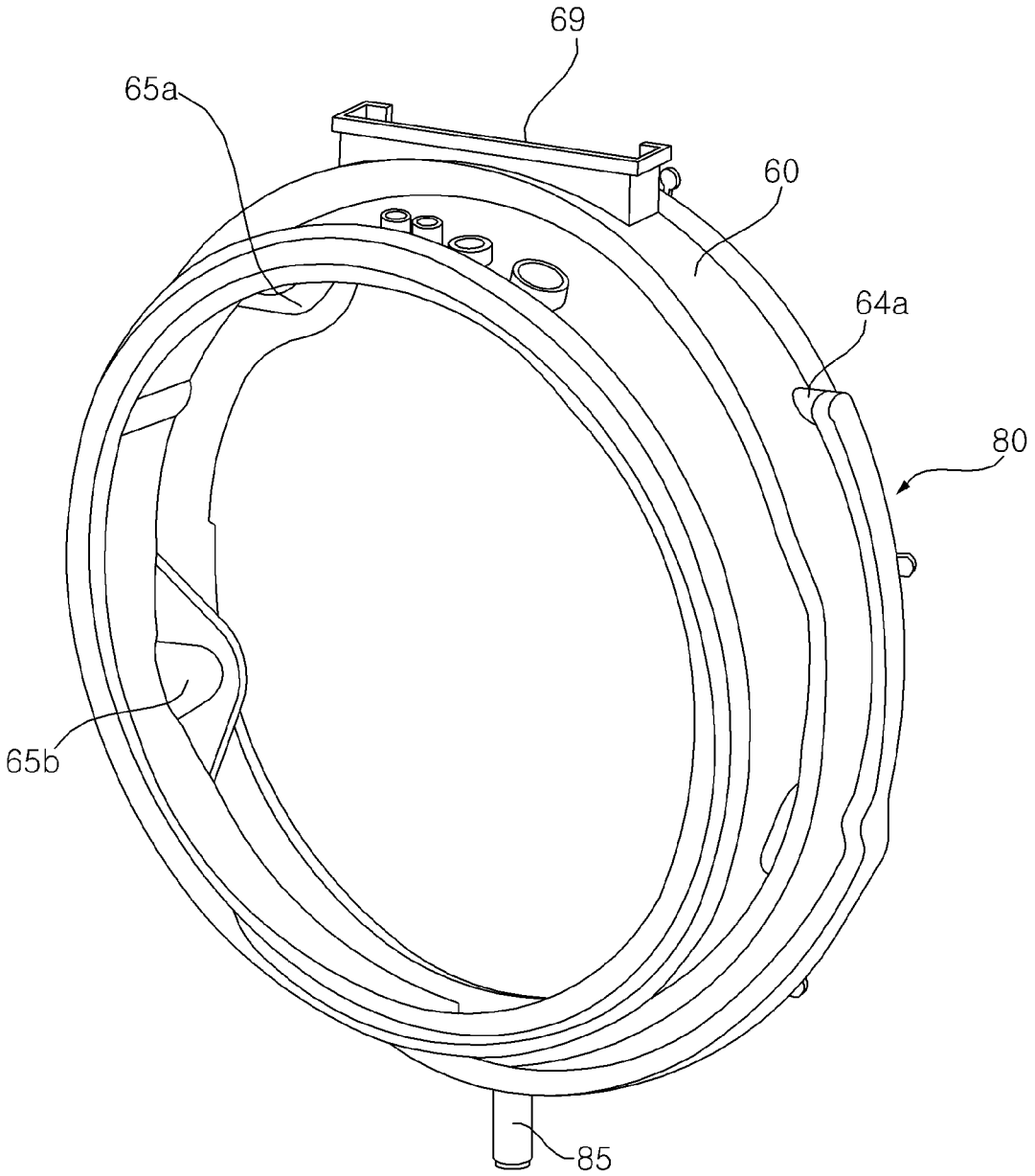
FIG. 19 is a perspective view of an assembly including a gasket and a distribution pipe shown in FIG. 18.
Figure 20:
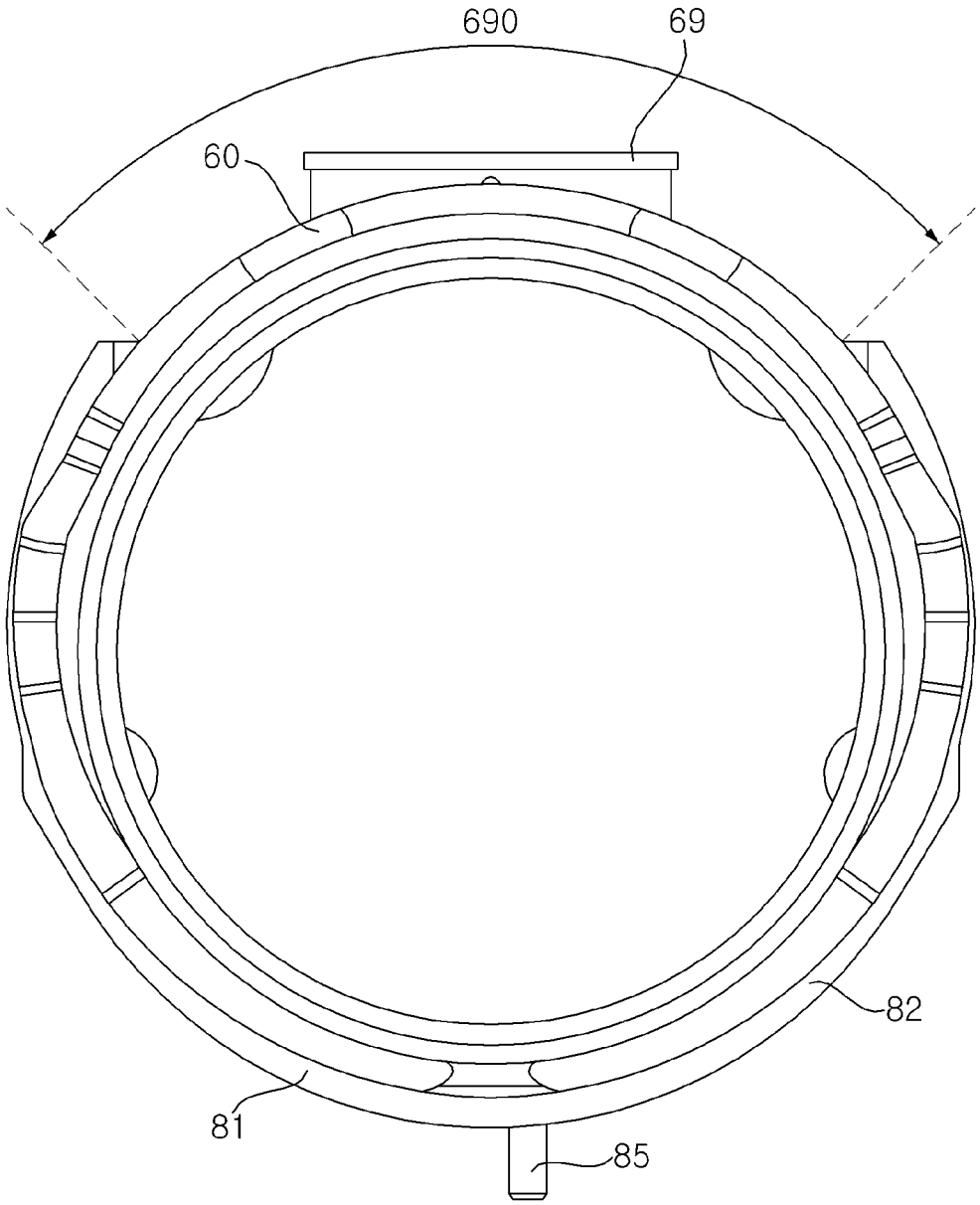
FIG. 20 is a front view of the assembly shown in FIG. 19.

Referring to FIGS. 18, 19, and 20, a washing machine according to a second embodiment of the present invention may provide a dry function as well as a wash function. The washing machine may include a dry heater for heating air, and a blow fan for supplying air heated by the heater to the inside of the tub 30. After a washing operation, the dry heater and the blow fan may be operated to dry laundry in the drum 40.

A washing machine according to a second embodiment of the present invention may further include a supply duct for supplying air into a tub 30 by a blow fan. The supply duct 69 may be formed integrally with a gasket 60. Alternatively, the supply duct 69 may be formed in the tub 31. In the present embodiment, the supply duct 69 is a hole, which is formed in the gasket 60 and allows the inside and the outside of the tub 30. The supply duct 69 may interfere with a distribution pipe 80 and a balancer 91 and 92 disposed on the outer circumferential surface 61 of the gasket body. Hereinafter, arrangement for reducing the interference therebetween will be described.

In the gasket 60, the supply duct 69 for supplying air blown by the blow fan into the tub 30 may be formed. The supply duct 69 may be formed on an upper side of the gasket body 61 and 62. The gasket 60 is different from the gasket 60 according to the above-described embodiment in that the supply duct 69 is further included. Unless mentioned otherwise, components and structures of the above-described embodiments may be applied.

The distribution pipe 80 may be disposed to surround at least a portion of the outer circumferential surface 61 of the gasket body. Specifically, in a surrounding area defined by a closed curved line surrounding the outer circumferential surface 61 of the gasket body, the transport conduit 81 and 82 may be disposed in a partial region thereof and not in other regions. The other regions in the surrounding area in which the transport conduit 81 and 82 is not disposed may be defined as a non-arrangement region 690.

Specifically, the transport conduit 81 and 82 of the distribution pipe 80 may include a first conduit part 81, which has one end connected to the inlet port 85, and a second conduit part 82, which has one end connected to the inlet port 85 and the first conduit part 81. The other end 81*a* of the first conduit part 81, and the other end 82*a* of the second conduit part 82 may be spaced apart from each other.

A space between the other end 81*a* of the first conduit part 81 and the other end 82*a* of the second conduit part 82 is defined as a clearance 88. The clearance 88 is disposed to overlap the non-arrangement region 690. The shape of the distribution pipe 80 may reduce interference between the distribution pipe 80 and the supply duct 69.

The non-arrangement region 690 may be disposed in the surrounding area above the center O of the gasket body 61 and 62.

The supply duct 69 may be disposed in an upper side of the gasket body 61 and 62. When the gasket body 61 and 62 is divided into four areas with reference to the center O of the gasket body 61 and 62, the upper side of the gasket body 61 and 62 may refer to an area above other areas. Alternatively, the upper side of the gasket body 61 and 62 may refer to an area including one of two points at which a vertical line OV passing through the center O of the gasket body 61 and 62 meets the gasket body 61 and 62.

In addition, the upper side of the gasket body 61 and 62 may be disposed to partially overall the non-arrangement area 690.

The supply duct 69 may be disposed in the clearance 88 between the other end 81*a* of the first conduit part 81 and the other end 82*a* of the second conduit part 82. The inlet port 85 may be disposed in a lower side of the transport conduit 81 and 82, and the first conduit part 81 and the second conduit part 82 of the transport conduit 81 and 82 may be connected to each other in a section where the inlet port 85 is disposed, and the first conduit part 81 and the second conduit part 82 are separated from each other in the upper side. Thus, the other ends 81*a* and 82*a* of the first and second conduit parts 81 and 82 may be referred to as upper ends 81*a* and 82*a* of the first and second conduit parts 81 and 82. That is, the supply duct 69 may be disposed in a space between the upper ends 81*a* and 82*a* of the first and second conduit parts 81 and 82. As the supply duct 69 are disposed in the space 99 where the upper ends 81*a* and 82*a* of the first and second conduit parts 81 and 82 are spaced apart from each other, the distribution pipe 80 and the supply duct 69 are not interfered with each other.

The balancer 90 may be disposed external to the gasket body 61 and 62 at the front surface 31 of the tub 30. Specifically, when the gasket body 61 and 62 is bilaterally divided into a first area and a second area, the balancer 90 may include a first balancer 91 disposed external to the first area and a second balancer 92 disposed external to the second area. The first conduit part 81 is disposed between the first balancer 91 and the outer circumferential surface 61 of the gasket body, and the second conduit part 81 is disposed between the second balancer 91 and the outer circumferential surface 61 of the gasket body, and accordingly, the first and second balancers 91 and 92 may be spaced apart from the outer circumferential surface 61 of the gasket body.

The upper end of the first balancer 91 and the upper end of the second balancer 92 may be spaced apart from each other, and the balancer 90 may not be disposed external to the upper side of the gasket body 61 and 62. At least a portion of the non-arrangement area 690 may be disposed not to overlap the upper side of the gasket body 61 and 62 in which the balancer 90 is not disposed. Accordingly, it is possible to reduce the interference between the supply duct 69 disposed in the non-arrangement area 690 and the first and second balancers 91 and 92.

The supply duct 69 may be disposed in a space between the upper end of the first balancer 91 and the upper end of the second balancer 92.

Referring to FIGS. 21 to 27, a washing machine according to the third embodiment of the present invention may include a gasket 60 for connecting a casing 10 and a tub 30, nozzles 66 and 67 for spraying water into the drum 40, a pump 70 for pumping water discharged from the tub 30, and a distribution pipe 800 for guiding the water pumped by the pump 70 to the nozzles 66 and 67. In addition, the washing machine may include a balancer 90 disposed at a front surface 31 of the tub 30, and a circulation pipe 860 for guiding the water pumped by the pump 70 to the distribution pipe 800.

The washing machine according to the third embodiment of the present invention is different from the washing machine according to the first embodiment of the present invention in terms of structure regarding the distribution pipe 800, the balancer 90, the pump 70, and the circulation pipe 860, but identical to the first embodiment apart from the structure. Thus, unless mentioned otherwise, the same configuration and structures may be applied to the third embodiment.

Figure 21:
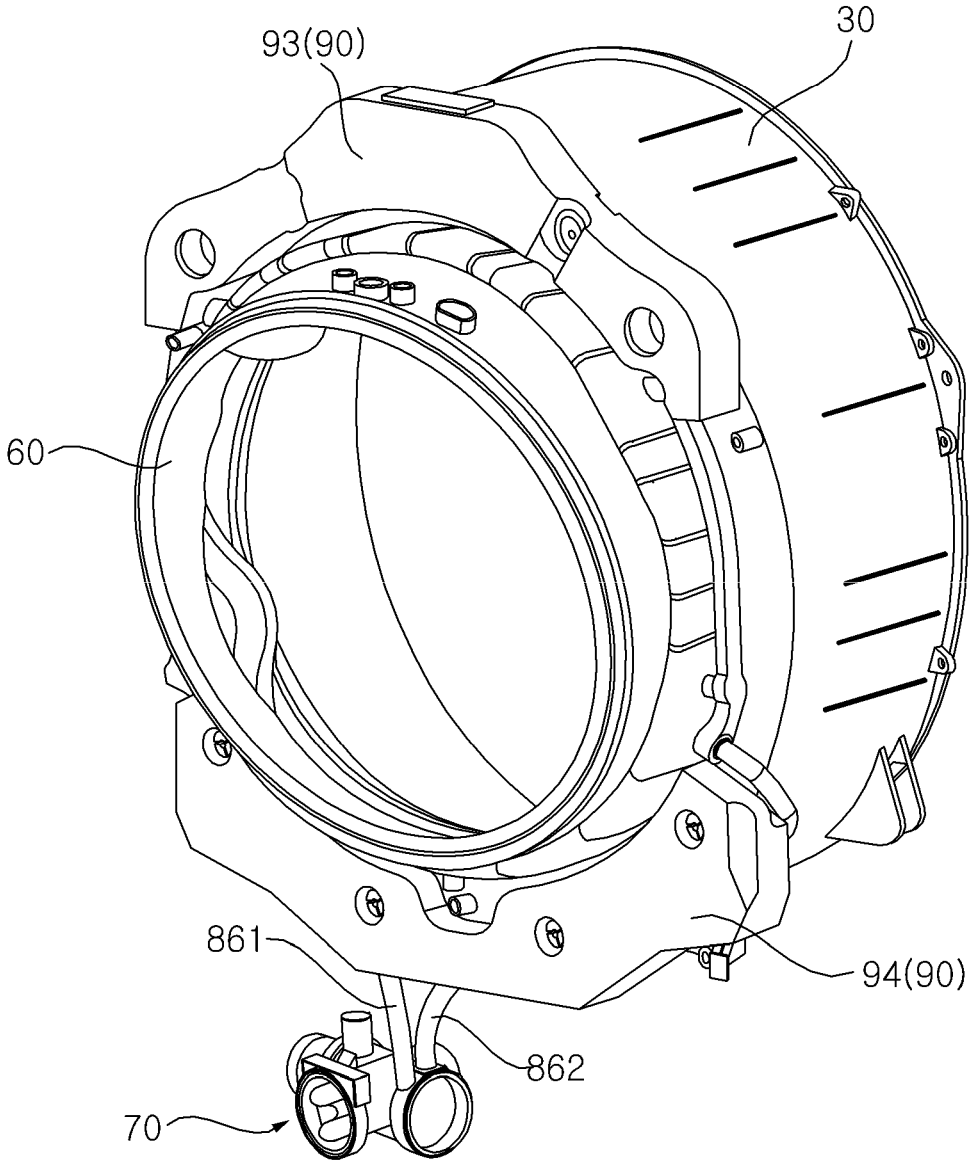
FIG. 21 illustrates a portion of a washing machine according to a third embodiment of the present invention.
Figure 22:
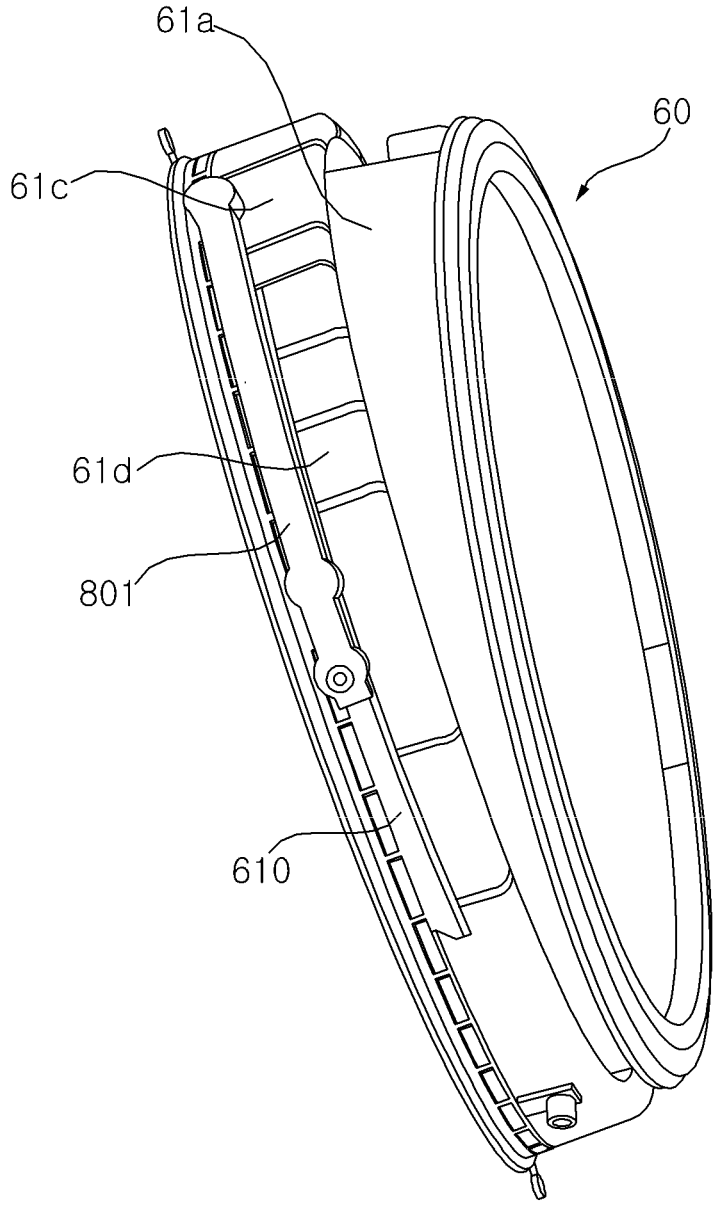
FIG. 22 is a perspective view of an assembly including a gasket and a distribution pipe shown in FIG. 21.

Referring to FIG. 21, the balancer 90 of the washing machine according to the third embodiment of the present invention includes an upper balancer 93 and a lower balancer 94, which are disposed at the front surface 31 of the tub 30 and separated from each other in a vertical direction. The upper balancer 93 is disposed in an upper side of the gasket body 61 and 62, and the lower balancer 94 is disposed in a lower side of the gasket body 61 and 62. Hereinafter, the upper balancer 93 and the lower balancer 94 may be referred to as a first balancer 93 and a second balancer 94.

The first balancer 93 and the second balancer 94 may be spaced apart from each other in the vertical direction. The first and second balancers 93 and 94 may be spaced apart from each other in the vertical direction on the left and right sides of the gasket body 61 and 62.

The distribution pipe 800 of the washing machine according to the third embodiment may include a first distribution pipe 801 and a second distribution pipe 802, which are disposed on the left and right sides of the gasket 60. The first distribution pipe 801 may supply water pumped by the pump 70 to a first nozzle 66, and the second distribution pipe 802 may supply water pumped by the pump 70 to a second nozzle 67.

Likewise to the first embodiment, when the gasket body 61 and 62 is bilaterally divided into the first area and a second area, the first nozzle 66 may include a first upper nozzle 66*a* and a first lower nozzle 66*b* disposed in the first area in the vertical direction. The second nozzle 67 may include a second upper nozzle 67*a* and a second lower nozzle 67*b* disposed in the second area in the vertical direction.

Likewise to the first and second nozzles 66 and 67, the first port receiving pipe 63, the second port receiving pipe 64, the first outlet port 83, and the second outlet port 84 may include first upper and lower port receiving pipes 63*a* and 63*b*, second upper and lower port receiving pipes 64*a* and 64*b*, first upper and lower outlet ports 83*a* and 83*b*, and second upper and lower outlet ports 84*a* and 84*b*, respectively.

The first distribution pipe 801 and the second distribution pipe 802 may be formed and disposed in a bilaterally symmetrical shape about a vertical line OV passing through the center O of the gasket 60. Alternatively, the first distribution pipe 801 and the second distribution pipe 802 may have the same shape and be disposed to be bilaterally symmetrical about the vertical line OV passing through the center O of the gasket 60.

The first and second distribution pipes 801 and 802 respectively include first and second transport conduits 810 and 820 for guiding water pumped by the pump 70, and first and second outlet ports 830 and 840 protruding from the first and second transport conduits 810 and 820 toward the gasket 60 and coupled to port receiving pipes 63 and 64. In addition, the first and second distribution pipes 801 and 802 may respectively include first and second inlet ports 851 and 852 through which water discharged from the pump is introduced. The first and second transport conduits 810 and 820 may guide water introduced through the first and second inlet ports 851 and 852 to the port receiving pipes 63 and 64.

The transport conduit 810 and 820 included in the distribution pipe 800 is disposed on an outer circumferential surface 61 of the gasket body. When the gasket body is bilaterally divided into a first area and a second area, the first transport conduit 810 is disposed on an outer circumferential surface of the first area, and the second transport conduit 820 is disposed on an outer circumferential surface of the second area. Each of the first and second transport conduits 810 and 820 includes an inner surface opposing the outer circumferential surface 61 of the gasket body, and an outer surface opposite to the inner surface.

The distribution pipe 800 may be coupled to the gasket 60 as the outlet ports 83 and 84 are inserted into the port receiving pipes 63 and 64. The first distribution pipe 801 may be coupled to the gasket 60 as the first outlet port 83 is inserted into the first port receiving pipe 63. The second distribution pipe 802 may be coupled to the gasket 60 as the second outlet port 84 is inserted into the second port receiving pipe 64.

The outlet ports 830 of the washing machine according to the third embodiment of the present invention, and a coupling relationship between the outlet port 830 and the gasket 60 are the same as described in the first embodiment, and thus, a detailed description thereof is herein omitted.

The first and second outlet ports 83 and 84 may respectively protrude from the inner surfaces of the first and second transport conduits 810 and 820, and the first and second inlet ports 851 and 852 may respectively protrude from the outer surfaces of the first and second transport conduits 810 and 820.

Since the first and second transport conduits 810 and 820 are formed and disposed symmetrically, as described above, the first transport conduit 810 will be hereinafter described, and a description of the second transport conduit 820 is omitted.

The transport conduit 810 may be divided into port sections 810*a* and 810*b* where the outlet port 830 is disposed, an introduction section 810*c* where the inlet port 851 is disposed, and guide ports 810*d* and 810*e*. The port sections 810*a* and 810*b* may include an upper port section 810*a* and a lower port section 810*b*. The guide sections 810*d* and 810*e* may include a middle guide section 810*e* and an upper guide section 810*d*.

The transport conduit 810 includes: the upper port section 810*a* where the upper outlet port 830 is disposed; the upper guide section 810*d* disposed at a lower side of the port section 810*a* and extending in an arc shape; the middle guide section 810*e* disposed under the upper guide section 810*d* to be further spaced apart from the outer circumferential surface 61 of the gasket 60 toward a lower side; the lower port section 810*b* disposed at a lower side of the middle guide section 810*e*; and the introduction section 810*c* in which the inlet port 851 is disposed, and which is disposed at the lower side the lower port section 810*b* and bent to be more adjacent to the vertical line OV, passing through the center O of the gasket 60, to a lower side.

The upper port section 810*a*, the upper guide section 810*d*, the middle guide section 810*e*, and the lower port section 810*b* included in the transport conduit 810 according to the third embodiment of the present invention are respectively identical to the upper port section 81*a*, the upper guide section 81*c*, the middle guide section 81*d*, and the lower port section 81*b* included in the transport conduit 81 according to the first embodiment of the present invention, and thus a detailed description thereof is herein omitted.

The transport conduit 810 may include the introduction section 810*c* disposed at the lower side of the lower port section 810*b* and bent in a direction to be more adjacent to the vertical line OV, passing through the center O of the gasket 60, toward a lower side. The inlet port 851 may be disposed in the introduction section 810*c*.

The introduction section 810*c* may be inclined in a direction to be further spaced apart from the vertical line OV, passing through the center C of the gasket 60, toward an upper side. At least an upper end of the introduction section 810*c* may be spaced apart from the outer circumferential surface 61 of the gasket body.

The lower port section 810*b* may extend upward from the upper end of the introduction section 810*c*. The lower port section 810*b* may be spaced apart from the outer circumferential surface 61 of the gasket body.

The inlet port 851 may protrude outward from the introduction section 810*c*, particularly an outer space of the introduction section 810*c*, in the outer surface of the transport conduit 810. The inlet pot 851 may protrude in a direction vertical to the outer surface of the introduction section 810*c*.

The outlet port 851 may be disposed lower than the lower outlet port 83*b*. The upper and lower outlet ports 83*a* and 83*b* may protrude from the transport conduit 810 toward the gasket body 61 and 62. The inlet port 851 mat protrude from the transport conduit 810 toward a direction opposite to the gasket body 61 and 62.

Figure 24:
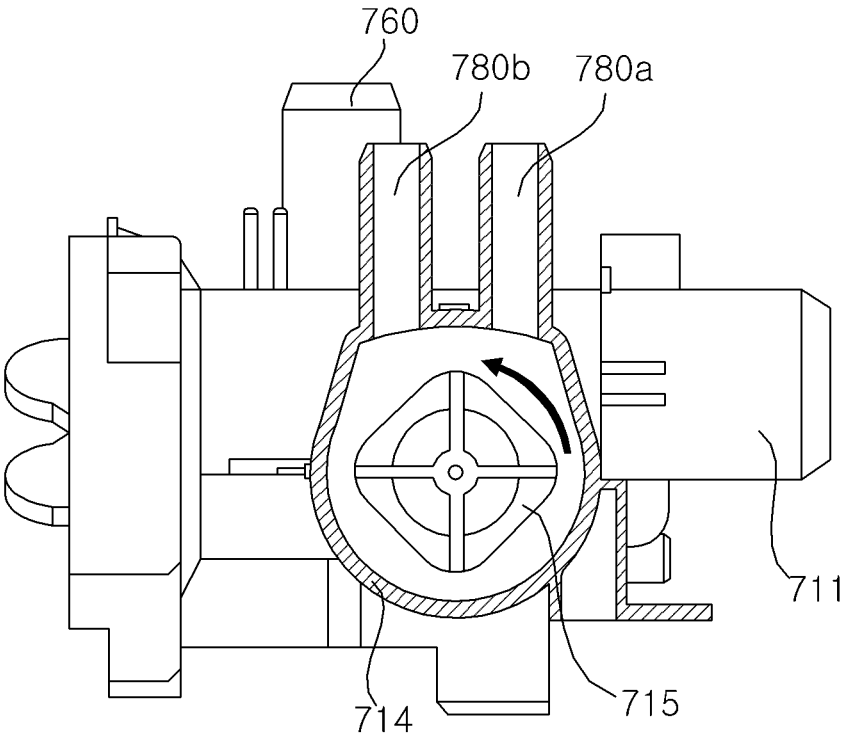
FIG. 24 is a side view of the pump shown in FIG. 21.
Figure 25:
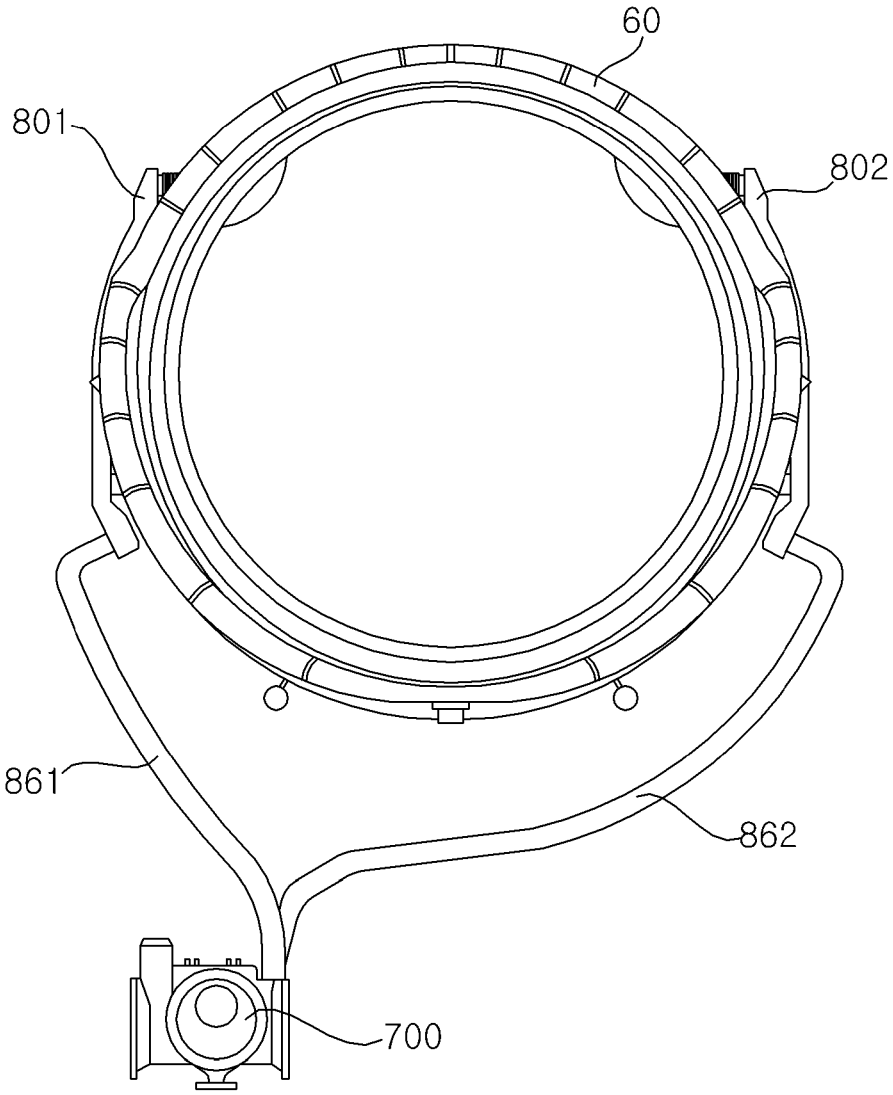
FIG. 25 is a front view of the assembly shown in FIG. 21.

Referring to FIGS. 24 and 25, the circulation pipe 860 of the washing machine according to the third embodiment of the present invention may include a first circulation pipe 861 for guiding water pumped by the pump 70 to the first distribution pipe 801, and a second circulation pipe 862 for guiding water pumped by the pump 70 to the second distribution pipe 802.

The first circulation pipe 861 and the second circulation pipe 862 may be a hose formed of a flexible substance and connecting the pump 70 and the distribution pipe 800, unlike the circulation pipe 86 according to the first embodiment.

The pump 70 may include two circulation ports 780*a* and 780*b*, unlike the first embodiment, and the two circulation ports 780*a* and 780*b* may be respectively coupled to the first and second circulation pipes 861 and 862.

Figure 26:
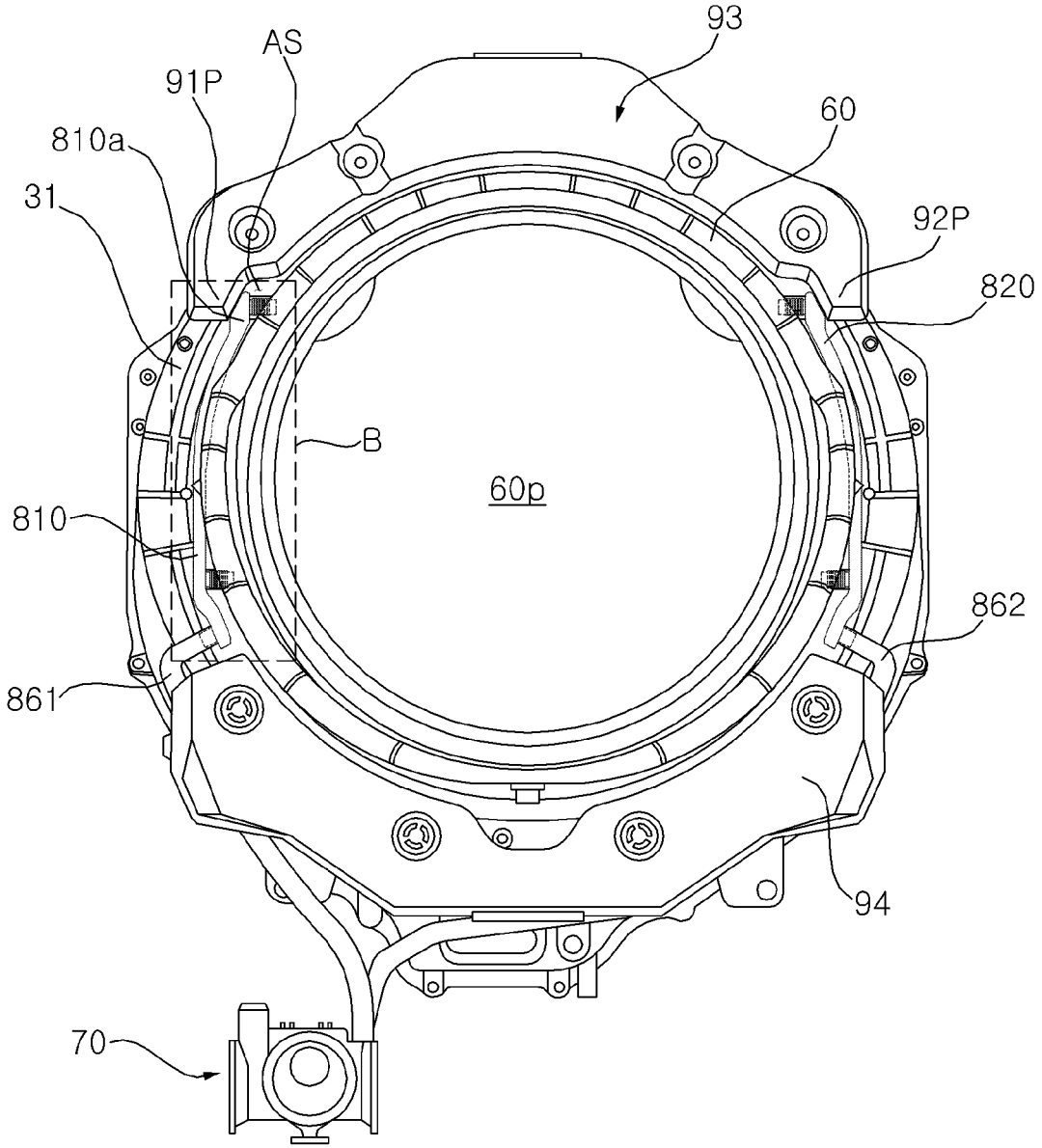
FIG. 26 is a front view of the assembly shown in FIG. 21.
Figure 27:
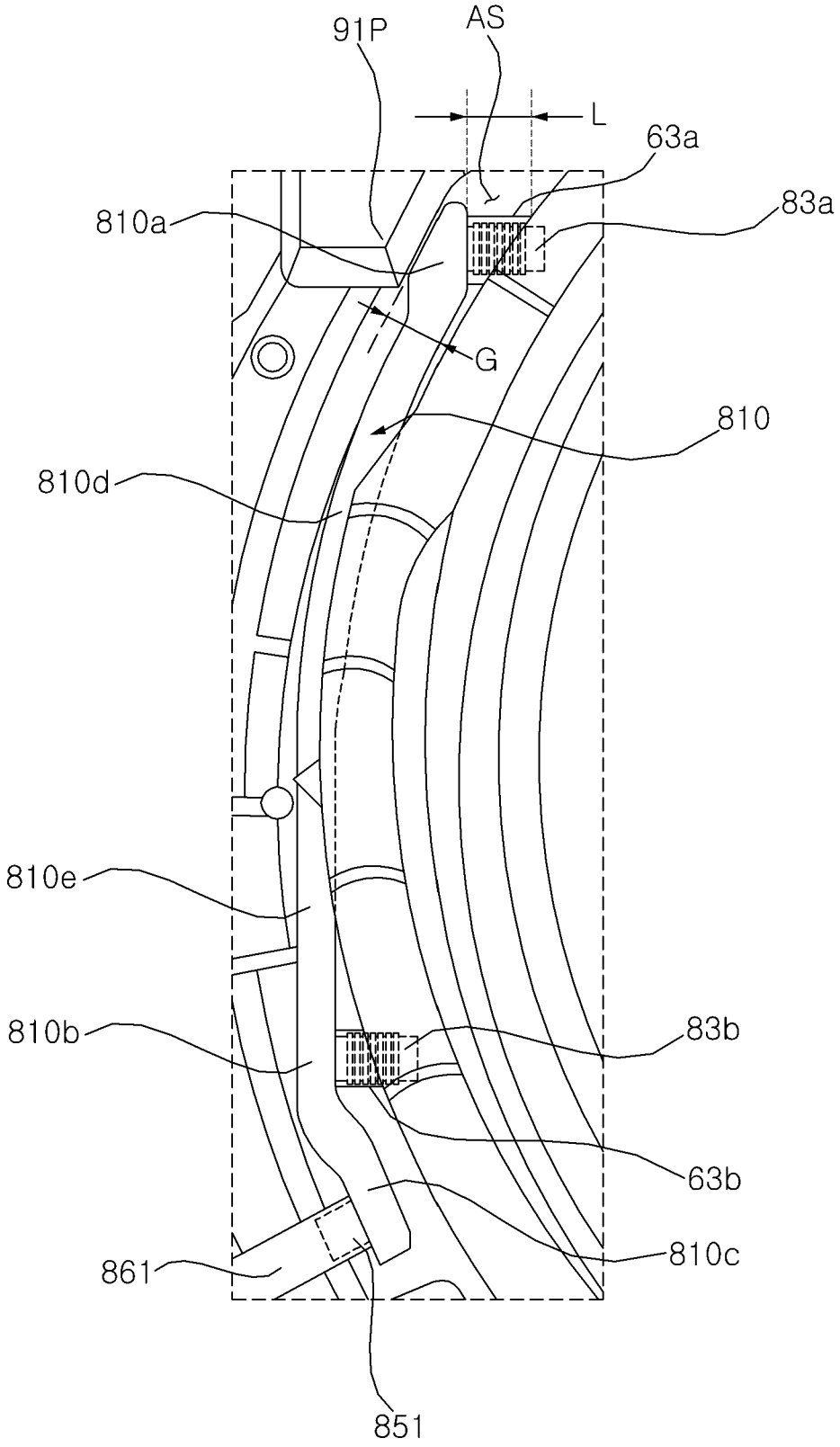
FIG. 27 is an enlarged view of a portion B shown in FIG. 26.

Hereinafter, referring to FIGS. 26 and 27, arrangement of the gasket 60, the distribution pipe 800, and the balancer 90 in the washing machine according to the third embodiment of the present invention will be described.

At least a portion of the first balancer 93 is spaced apart from the outer circumferential surface 61 of the gasket bod. At least a portion of each of the first and second transport conduits 81 and 82 is disposed in a space between the outer circumferential surface 61 of the gasket body 61 and 62 and the first balancer 93.

The left lower end and the right lower end of the first balancer 93 are spaced apart from the outer circumferential surface 61 of the gasket body. The first upper port section 810*a* of the first transport conduit is disposed in a space between the left lower end of the first balancer 93 and the outer circumferential surface 61 of the gasket body. The second upper port section 820*a* of the second transport conduit 820 is disposed in a space between the right lower end of the first balancer 93 and the outer circumferential surface 61 of the gasket body.

The first balancer 93 may include a position limiting part 90*b* that prevents separation of the upper outlet pots 83*a* and 8*b* from the upper port receiving pipes 63*a* and 64*a*. The position limiting part 90*p* forms the lower end of the first balancer 93. The left lower end of the first balancer is referred to as a first position limiting part 91*p*, and the right lower end of the first balancer is referred to as a second position limiting part 92*p*.

The first and second position limiting parts 91*p* and 92*p* are spaced apart from the outer circumferential surface 61 of the gasket body. The first upper port section 810*a* is disposed in a space between the first position limiting part 91*p* and the outer circumferential surface 61 of the gasket body. The second upper port section 820*a* is disposed in a space between the second position limiting part 92*p* and the outer circumferential surface 61 of the gasket body.

Each of the first and second transport conduits 810 and 820 includes an inner surface opposing to the outer circumferential surface 61 of the gasket body, and an outer surface opposite to the inner surface. The first balancer 93 includes an inner surface opposing to the outer circumferential surface 61 of the gasket body. Outer surfaces of the first and second upper port sections 810*a* and 820*a* of the first and second transport conduit parts 810 and 820 oppose the inner surface of the balancer 90.

The upper port sections 810*a* and 820*a* may include supporting surfaces 810*a*2 and 820*a*2 that are disposed in the opposite side to port surfaces 810*a*1 and 820*a*1 where the upper outlet ports 83*a* and 73*a* are disposed. That is, the supporting surfaces 810*a*2 and 820*a*2 refer to outer surfaces of the upper port sections 810*a* and 820*a*.

Hereinafter, the port surface 810*a*1 and the supporting surfaces 810*a*2 of the first upper port section 810*a* are referred to as a first upper port surfaces 810*a*1 and a first supporting surfaces 810*a*2, respectively, and the port surface 820*a*1 and the supporting surface 820*a*2 of the second upper port section 820*a* are referred to as a second upper port surface 820*a*1 and a second supporting surface 820*a*2, respectively.

The first position limiting part 91*p* of the first balancer 91 may come into contact with the first supporting surface 810*a*2, and the second position limiting part 92*p* of the first balancer 91 may come into contact with the second supporting surface 820*a*2 of the second upper port section 820*a*. Alternatively, the first position limiting part 91*p* of the first balancer 91 may be disposed in such a way that an interval between the first position limiting part 91*p* and the first supporting surface 810*a*2 is shorter than a length by which the first upper outlet port 83*a* is inserted into the first port receiving pipe 63*a*, while an interval between the second position limiting part 92*p* and the second supporting surface 820*a*2 is shorter than a length by which the second upper outlet port 84*a* is inserted into the second port receiving pipe 64*a*

The first supporting surface 810*a*2 may come into contact with the first position limiting part 91*p*. Alternatively, the first supporting surface 810*a* may be spaced apart from the first position limiting part 91*p*, and an interval between the first supporting surface 810*a* and the first position limiting part 91*p* may be shorter than a length by which the first upper outlet port 83*a* is inserted into the first upper port receiving pipe 63*a*.

The second supporting surface 820*a*2 may come into contact with the second position limiting part 92*p*. Alternatively, the second supporting surface 820*a* may be spaced apart from the second position limiting part 92*p*, and an interval between the second supporting surface 820*a* and the second position limiting part 92*p* may be shorter than a length by which the second upper outlet port 84*a* is inserted into the second upper port receiving pipe 64*a*.

Accordingly, it is possible to prevent separation of the upper outlet ports 83*a* and 84*a* from the upper port receiving pipes 63*a* and 64*a*.

The first balancer 92 and the second balancer 94 may be formed to be bilaterally symmetrical. Hereinafter, the first distribution pipe 801 and the left side of the first and second balancer 93 and 94 will be described, and a description about the second distribution pipe 802 and the right side of the first and second balancers 93 and 94 will be omitted.

An inner surface of the position limiting part 91*p* may be inclined in a direction to be farther away from a vertical line OV, passing through the center O of the gasket body, from an upper side toward a lower side.

The supporting surface 810*a*2, which is the outer surface of the upper port section 810*a*, and the inner surface of the position limiting part 91*p* oppose each other. Accordingly, the supporting surface 810*a*2 may be inclined in a direction to be farther away from the vertical line OV from the upper side toward the lower side.

The supporting surface 810*a*2 of the upper port section 810*a*, and the inner surface of the position limiting part 91*p* of the first balancer 93 opposing the supporting surface 810*a*2 may be inclined in the same direction, so that the first balancer 93 may stably support the distribution pipe 800 and separation of the distribution pipe 800 from the gasket 60 may be prevented.

The position limiting part 910, which is the lower end of the first balancer 93, may extend to a height corresponding to the upper port section 810*a*. The position limiting part 91*p* may extend to below the upper outlet port 83*a* to thereby present separation of the upper outlet port 83*a* from the upper port receiving pipe 63*a*. Alternatively, the position limiting part 91*p* may extend to a height corresponding to an upper side of the upper guide section 810*d*.

As the inlet port 851 is disposed below the lower outlet port 83*b*, a force toward the gasket body 61 and 62 is applied to the introduction section 810*c* when circulating water is sprayed upon operation of the pump. Thus, although the lower port section 810*b* is not supported by the balancer 90, the lower outlet port 83*b* is less likely to be separated from the lower port receiving pipe 63*b*.

The upper end of the second balancer 94 may be disposed lower than the distribution pipe 800. That is, the upper end of the second balancer 94 is disposed lower than the inlet port 815 at the bottom of the distribution bottom 800 and the introduction section 810*c*. Thus, there is no balancer disposed external to the upper guide section 810*d*, the middle guide section 810*e*, the lower port section 810*b*, and the introduction section 810*c*.

Accordingly, when the washing machine needs to be repaired, it is possible to separate the lower outlet ports 83*b* and 84*b* from the lower port receiving pipes 63*b* and 64*b*, without separating the balancer 90 from the tub 30, and then separate the upper outlet ports 83*a* and 84*a* from the upper port receiving pipes 63*a* and 64*a*.

A space spaced apart from the position limiting part 91*p* and the outer circumferential surface of the gasket body is defined as an assembling space AS. That is, the position limiting part 91*p* may define the assembly space AS in a space between the position limiting part 91*p* and the outer circumferential surface 61 of the gasket body. The first upper port section 810*a* is disposed in the assembling space AS.

Figure 23:
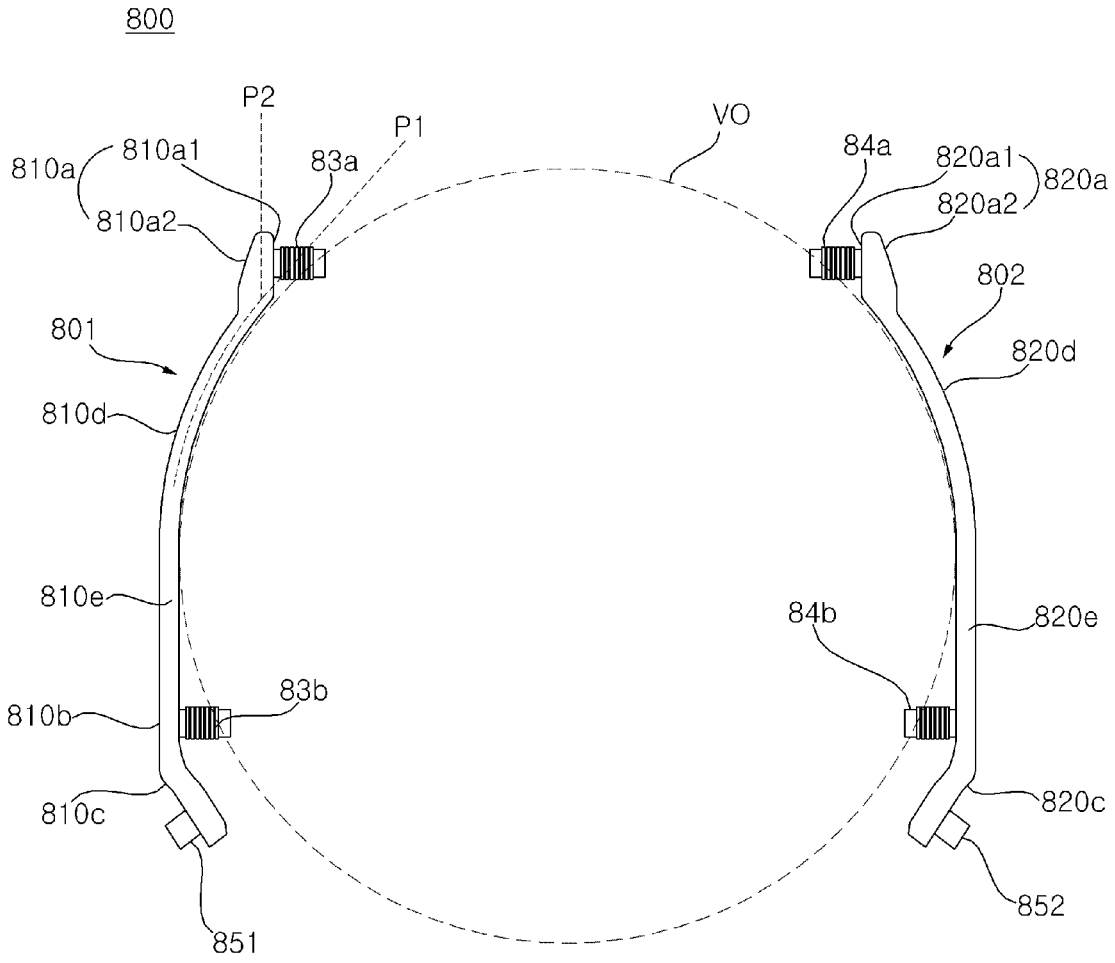
FIG. 23 is a front view of the distribution pipe shown in FIG. 21.

The upper guide section 810*d* of the transport conduit 810 is curved in a convex shape to correspond to the outer circumferential surface 61 and 62 of the gasket body. The upper port section 810*a* is bent at the upper guide section 810*d* in a direction to be farther away from the gasket body 61 and 62. At least a portion of the upper port section 810*a* may be disposed in the assembling space AS. In FIG. 23, P1 indicates a curved line forming the upper guide section 810*d*, and P2 indicates a shape in which the upper port section 810*a* is bent from the upper guide section 810*d*.

The upper guide section 810*d* may be disposed below the outside of the assembling space AS. The position limiting part 91*p* of the first balancer 93 may define an assembling space AS in a space between the position limiting part 91*p* and an upper side of the gasket body 61 and 62 (that is, a portion belonging to an upper semicircle with reference to the center O of the gasket body). In this case, the assembling space AS may be open by a gap G between the lower end of the first balancer 93 and the gasket body 61 and 62, and the lower guide section 810*d* passes through the open portion of the assembling space AS from below, so that the upper port section 810*a* can be inserted into the assembling space AS.

Meanwhile, the upper outlet port 83*a* may extend from the upper port section 810*a* in a horizontal direction, and the first balancer 93 may extend to below the upper outlet port 83*a*. Specifically, the lower end of the position limiting part 91 of the first balancer 93, which defines the assembling space AS, extends to below the upper outlet port 83*a*.

Although some embodiments have been described above, it should be understood that the present invention is not limited to these embodiments, and that various modifications, changes, alterations and variations can be made by those skilled in the art without departing from the spirit and scope of the invention. Therefore, it should be understood that the above embodiments are provided for illustration only and are not to be construed in any way as limiting the present invention.

What is claimed is:

1. A washing machine comprising:

a casing that defines a laundry entry hole at a front surface of the casing;

a tub disposed in the casing and configured to receive water, the tub defining a tub opening at a front surface of the tub;

a drum rotatably disposed in the tub;

a gasket comprising a gasket body that defines a passage connecting the laundry entry hole to the tub opening;

a plurality of nozzles disposed at an inner circumference of the gasket body and configured to spray water into the drum;

a pump configured to circulate water discharged from the tub;

a distribution pipe configured to supply water pumped by the pump to the plurality of nozzles; and a first balancer disposed at the front surface of the tub, at least a portion of the first balancer being spaced apart from an outer circumference of the gasket body, wherein the distribution pipe comprises:

an inlet port connected to the pump, a transport conduit that is disposed outside the gasket body and extends from the inlet port along the outer circumference of the gasket body, and a plurality of outlet ports that protrude from the transport conduit toward the gasket body and that are configured to supply water to the plurality of nozzles, and wherein the transport conduit is disposed in a space that is defined radially between the outer circumference of the gasket body and the first balancer along a radial direction of the gasket body.

2. The washing machine of claim 1, wherein the gasket body has a first area and a second area that corresponds, respectively, to bilateral areas of the gasket body, wherein the plurality of nozzles comprise a first upper nozzle and a first lower nozzle that are vertically arranged in the first area of the gasket body, and wherein the plurality of outlet ports comprise a first upper outlet port configured to supply water to the first upper nozzle, and a first lower outlet port configured to supply water to the first lower nozzle.

3. The washing machine of claim 2, wherein the first balancer comprises a position limiting part spaced apart from the outer circumference of the gasket body, wherein the transport conduit comprises a first upper port section that defines an upper end of the transport conduit and that is disposed in a space between the position limiting part and the outer circumference of the gasket body, and wherein the first upper outlet port protrudes from the first upper port section.

4. The washing machine of claim 3, wherein the gasket further comprises a plurality of port receiving pipes that protrude from the outer circumference of the gasket body and that are configured to communicate with the plurality of nozzles, respectively, wherein the plurality of port receiving pipes comprise a first upper port receiving pipe and a first lower port receiving pipe that are vertically arranged in the first area of the gasket body and that are configured to communicate with the first upper nozzle and the first lower nozzle, respectively, and wherein the first upper outlet port is configured to be inserted into the first upper port receiving pipe, and the first lower outlet port is configured to be inserted into the first lower port receiving pipe.

5. The washing machine of claim 4, wherein the first upper port section comprises:

a port surface that faces a vertical line passing through a center of the gasket body, the first upper outlet port being disposed on the port surface; and a supporting surface that faces a direction away from the vertical line.

6. The washing machine of claim 5, wherein the supporting surface is configured to:

contact the position limiting part; or be spaced apart from the position limiting part to define an interval between the position limiting part and the support surface, the interval being shorter than an insertion length of the first upper outlet port inserted into the first upper port receiving pipe.

7. The washing machine of claim 5, wherein the first upper port receiving pipe and the first upper outlet port are disposed vertically above a horizontal line passing through the center of the gasket body, wherein the position limiting part comprises an inner surface facing the supporting surface of the first upper port section, wherein each of the inner surface of the position limiting part and the supporting surface of the first upper port section is inclined with respect to the vertical line, wherein a horizontal distance between the vertical line and an upper side of the inner surface of the position limiting part is less than a horizontal distance between the vertical line and a lower side of the inner surface of the position limiting part, and wherein a horizontal distance between the vertical line and an upper part of the supporting surface of the first upper port section is less than a horizontal distance between the vertical line and a lower part of the supporting surface of the first upper port section.

8. The washing machine of claim 5, wherein the transport conduit further comprises a first lower port section at which the first lower outlet port is disposed, and a guide section that extends from the first lower port section to the first upper port section, wherein an upper side of the guide section has an arc shape corresponding to the outer circumference of the gasket body, and wherein the first upper port section is bent from the upper side of the guide section in a direction away from the outer circumference of the gasket body.

9. The washing machine of claim 3, wherein the transport conduit comprises a first lower port section at which the first lower outlet port is disposed, the first lower port section being disposed vertically below the first upper port section, wherein the first balancer is disposed at an outside of the first area of the gasket body and extends from a first position facing the first upper port section to a second position facing the first lower port section, and wherein an interval between the first lower port section and the first balancer is greater than an interval between the first upper port section and the first balancer.

10. The washing machine of claim 3, wherein the first balancer is disposed at an upper side of the gasket body, wherein the position limiting part is disposed at a lower end of the first balancer and defines an assembling space between the position limiting part and the outer circumference of the gasket body.

11. The washing machine of claim 10, wherein the position limiting part extends to a position vertically below the first upper outlet port.

12. The washing machine of claim 10, further comprising a second balancer disposed at the front surface of the tub, the second balancer being disposed vertically below the gasket body, wherein the distribution pipe comprises a first distribution pipe configured to supply water pumped by the pump to the first upper nozzle and the first lower nozzle, wherein the first distribution pipe comprises:

a first inlet port configured to receive water pumped by the pump, a first transport conduit disposed on an outer circumferential surface of the first area of the gasket body and configured to guide water received through the first inlet port, and the first upper outlet port and the first lower outlet port, wherein the first balancer and the second balancer are spaced apart from each other in a vertical direction at a left side of the gasket body and a right side of the gasket body, and wherein an upper end of the second balancer is disposed vertically below the first inlet port and the first lower outlet port.

13. The washing machine of claim 2, wherein the first upper outlet port and the first lower outlet port protrude from the transport conduit toward the gasket body, and wherein the inlet port is disposed below the first lower outlet port and protrudes from the transport conduit toward a direction opposite to the gasket body.

14. The washing machine of claim 13, wherein the first upper outlet port and the first lower outlet port extend in parallel to each other.

15. The washing machine of claim 1, further comprising a second balancer disposed at the front surface of the tub, at least a portion of the second balancer being spaced apart from the outer circumference of the gasket body, wherein the gasket body has a first area and a second area that correspond, respectively, to bilateral areas of the gasket body, wherein the first balancer is disposed at an outside of the first area of the gasket body, and wherein the second balancer is disposed at an outside of the second area of the gasket body.

16. The washing machine of claim 15, wherein the transport conduit comprises:

a first conduit part disposed on an outer circumferential surface of the first area of the gasket body and configured to guide, to a nozzle disposed in the first area among the plurality of nozzles, water received through the inlet port; and a second conduit part disposed on an outer circumferential surface of the second area of the gasket body, and configured to guide, to a nozzle disposed in the second area among the plurality of nozzles, water received through the inlet port, wherein a lower end of the first conduit part and a lower end of the second conduit part are connected to each other at the inlet port, and wherein an upper end of the first conduit part and an upper end of the second conduit part are separated from each other.

17. The washing machine of claim 15, further comprising a supply duct disposed at an upper side of the gasket body and configured to supply air to the tub.

18. The washing machine of claim 17, wherein an upper end of the first balancer and an upper end of the second balancer are spaced apart from each other, and wherein the supply duct is disposed in a space between the upper end of the first balancer and the upper end of the second balancer.

19. The washing machine of claim 17, wherein the transport conduit comprises:

a first conduit part disposed on an outer circumferential surface of the first area of the gasket body and configured to guide, to a nozzle disposed in the first area among the plurality of nozzles, water received through the inlet port; and a second conduit part disposed on an outer circumferential surface of the second area of the gasket body and configured to guide, to a nozzle disposed in the second area among the plurality of nozzles, water received through the inlet port, wherein a lower end of the first conduit part and a lower end of the second conduit part are connected to each other at the inlet port, wherein an upper end of the first conduit part and an upper end of the second conduit part are spaced apart from each other, and wherein the supply duct is disposed in a space between the upper end of the first conduit part and the upper end of the second conduit part.

20. The washing machine of claim 2, wherein the gasket further comprises a plurality of port receiving pipes that protrude from the outer circumference of the gasket body and that are configured to communicate with the plurality of nozzles, respectively, wherein the plurality of port receiving pipes comprise a first upper port receiving pipe and a first lower port receiving pipe that are vertically arranged in the first area of the gasket body and that are configured to communicate with the first upper nozzle and the first lower nozzle, respectively, wherein the first upper outlet port is configured to be inserted into the first upper port receiving pipe, and the first lower outlet port is configured to be inserted into the first lower port receiving pipe, and wherein the transport conduit is configured to contact the first balancer or be spaced apart from the first balancer to define an interval between the first balancer and the transport conduit, the interval being shorter than an insertion length of the first upper outlet port inserted into the first upper port receiving pipe.

* * * * *